US006512912B2

(12) United States Patent
Kamei et al.

(10) Patent No.: US 6,512,912 B2
(45) Date of Patent: Jan. 28, 2003

(54) IMAGE FORMING APPARATUS INCLUDING TRANSFER DEVICE OUTER DISPLACIVE TYPE FERROELECTRIC LAYER

(75) Inventors: Yukikazu Kamei, Ichihara (JP); Tomohiro Oikawa, Funabashi (JP); Shiro Wakahara, Sakura (JP); Hideki Onishi, Sakura (JP); Hiroshi Doshoda, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/883,656

(22) Filed: Jun. 18, 2001

(65) Prior Publication Data

US 2002/0028098 A1 Mar. 7, 2002

(30) Foreign Application Priority Data

Jun. 19, 2000 (JP) ..... 2000-183603

(51) Int. Cl.[7] ..... G03G 15/16
(52) U.S. Cl. ..... 399/313
(58) Field of Search ..... 399/168, 174, 399/176, 297, 310, 313; 101/130, 467, 468; 204/192.15, 192.18, 192.26; 430/35, 51; 347/114; 250/324, 325, 326

(56) References Cited

U.S. PATENT DOCUMENTS 5,191,834 A * 3/1993 Fuhrmann et al. ..... 101/130
5,308,462 A * 5/1994 Iijima et al. ..... 204/192.15
5,580,688 A * 12/1996 Hirt ..... 430/35
5,929,886 A * 7/1999 Snelling et al. ..... 347/114

FOREIGN PATENT DOCUMENTS

| | | | |
|---|---|---|---|
| JP | 62-251779 | * | 2/1987 |
| JP | 06-175441 | * | 6/1994 |
| JP | 10-240928 | | 3/2000 |

* cited by examiner

*Primary Examiner*—Hoan Tran
(74) *Attorney, Agent, or Firm*—Dike, Bronstein, Roberts & Cushman IP; David C. Conlin; David A. Tucker

(57) ABSTRACT

In an image forming portion, a grounded, drum-shaped photosensitive member rotating in a predetermined direction is provided. Arranged around the photosensitive member are a charger, an exposure unit, a developing unit, a cleaning unit, an erasing unit and a transfer roller with a ferroelectric layer formed on the surface thereof. The ferroelectric laminated transfer roller includes a grounded, metal core of aluminum, a conductive rubber layer of an elastomer having a volume resistivity of $10^{5}$'Ω•cm or below with a thickness of about 3 mm, molded in a roller shape formed on the metal core and a ferroelectric element having a film thickness of some μm to some tens of micrometers, coating the surface of the conductive rubber layer.

28 Claims, 20 Drawing Sheets

Graph of the time-dependent variation of the surface potential of the ferroelectric after poling

IMAGE FORMING APPARATUS INCLUDING TRANSFER DEVICE OUTER DISPLACIVE TYPE FERROELECTRIC LAYER

BACKGROUND OF THE INVENTION (1) Field of the Invention

The present invention relates to an image forming apparatus with a transfer device which transfers the toner images formed on the image bearer to transfer media, and preferably relates to an image forming apparatus in which toner images are transferred to transfer media under the presence of electric field, such as a copier, laser beam printer and other image recording apparatus using an electrophotographic process including liquid development process.

(2) Description of the Prior Art

FIGS. 1A and 1B show a conventional electrophotographic image forming apparatus such as a copier, laser printer or the like. In FIG. 1A, the image forming apparatus includes: a photosensitive member 101 as an image bearer; a charger 102 for charging photosensitive member 101; an exposure unit 103 for forming a latent image by light exposure; a developing unit 104 for performing development with toner; a transfer device 105 for transferring the toner image to a transfer medium 108; a fixing device (not shown) for fixing the toner image on transfer medium 108; an erasing device 106 for erasing charge on the photosensitive member; and a cleaning unit 107 for removing the leftover toner from the photosensitive member. This apparatus further includes power supplies 109, 110 and 111 for applying voltages to charger 102, developing unit 104 and transfer device 105, respectively.

In recent years, various contact type transfer devices have been developed in order to provide an ozoneless, low-cost, compact and energy saving configuration for transfer device 105 for transferring the toner image on photosensitive member 101 to transfer medium 108, as shown in FIG. 1B.

This contact type transfer device 105 has a roller configuration made of a metal core 105-1 of aluminum, iron or the like, which is covered with an electrically conductive tubular elastomeric element 105-2 or an electrically insulative tubular elastomeric element 105-2 (polyurethane, EPDM, silicone rubber, NBR, etc.) in which a conductor (ionic conductors, carbon black, metal oxides, metal powders, graphite, etc.) is dispersed. This roller (to be referred to hereinbelow as transfer roller) is set in abutment with the photosensitive member 101 surface and a bias voltage of +(−)500 V to +(−)3000 V is applied to metal core 105-1, so as to cause the toner on photosensitive member 101 to transfer to transfer medium 108.

Other than the above problem, ozone generation due to a Paschen discharge from transfer device 105 should be mentioned. Contact type transfer device 105 has a roller configuration made of a metal core 105-1 of iron, aluminum or the like, which is covered with an elastomer(silicone rubber, polyurethane rubber, EPDM, NBR, etc.) 105-2 in which a conductor (such as ionic conductors, carbon black, metal oxides, metal powders, graphite, etc. as a conductive filler) is dispersed. A voltage is applied to the metal core when this roller is set in abutment with the photosensitive member 101 surface with transfer medium 108 in between so that the voltage can be applied to the undersurface of transfer medium 108. The volume resistivity of the elastomer used in this configuration is $10^6$ to $10^{10}$ Ω•cm.

However, since the conventional transfer device 105 performs a transfer operation by applying a bias voltage to transfer roller core 105-1, high-voltage power supply 111 is needed, which leads to increase in the cost of the apparatus, increase in apparatus size for installing the power source, increase in consumption of power and increase in the number of consumable parts, results in inconsistency with regard to energy saving and ecologically-oriented development, which have become increasingly important for manufactures.

It is true that the above conventional contact transfer device 105 thus configured generates ozone in an amount of only about 1/50 as much as that from a corona-discharge type, but it still releases ozone.

The inventors hereof have earnestly studied the mechanism of ozone generation from the contact type transfer device. As a result, it was found that Paschen discharge will occur at the micro gap Ep (the gap distance of about 10 to 100 μm) near the nip N on the entrance side with respect to the rotational direction of the photosensitive member, generating ozone. It has been known that the thus generated ozone corrodes the photosensitive member and other elements, degrading the image quality.

SUMMARY OF THE INVENTION

The present invention has been achieved in order to solve the above problems, it is therefore an object of the present invention to provide an image forming apparatus capable of transferring images from the photosensitive member to transfer media without applying a bias voltage to the transfer device and generating even a small amount of ozone.

The present invention for attaining the above object is configured as follows:

In accordance with the first aspect of the present invention, an image forming apparatus including a transfer device for transferring toner images from an image bearer to a transfer medium comprising:

a ferroelectric subjected to a dipole orienting treatment, and the transfer device being arranged opposing to the image bearer and having a layer containing the ferroelectric at least as part, wherein the toner images are transferred to the transfer medium by electric field formed by the dipoles thus oriented.

In accordance with the second aspect of the present invention, the image forming apparatus having the above first aspect is characterized in that the transfer device is set floating without any voltage applied thereto.

In accordance with the third aspect of the present invention, the image forming apparatus having the above first or second aspect is characterized in that the transfer device is constructed such that the ferroelectric layer is formed on an electrically conductive support.

In accordance with the fourth aspect of the present invention, the image forming apparatus having the above third aspect is characterized in that the electrically conductive support is grounded.

In accordance with the fifth aspect of the present invention, the image forming apparatus having any one of the above first through fourth aspects is characterized in that the polarity of the ferroelectric layer is set positive when the toner on the image bearer is charged negative and the polarity of the ferroelectric layer is set negative when the toner on the image bearer is charged positive.

In accordance with the sixth aspect of the present invention, the image forming apparatus having any one of the above first through fourth aspects is characterized in that a potential difference is given between the surface potential of the ferroelectric and that of the toner portion on the image bearer.

In accordance with the seventh aspect of the present invention, the image forming apparatus having any one of the above first through fourth aspects is characterized in that the ferroelectric layer is formed with a film thickness of 8 μm or greater.

In accordance with the eighth aspect of the present invention, the image forming apparatus having any one of the above first through fourth aspects is characterized in that the ferroelectric at least includes an organic material as part thereof.

In accordance with the ninth aspect of the present invention, the image forming apparatus having any one of the above first through fourth aspects is characterized in that the ferroelectric at least includes an inorganic material as part thereof.

In accordance with the tenth aspect of the present invention, the image forming apparatus having any one of the above first through fourth aspects is characterized in that the inorganic material is a ceramics sintered compact composed of at least three components.

In accordance with the eleventh aspect of the present invention, the image forming apparatus having any one of the above first through fourth aspects is characterized in that an abrasive-resistant material covers or coats the surface layer of the ferroelectric.

In accordance with the twelfth aspect of the present invention, the image forming apparatus having any one of the above first through fourth aspects is characterized in that the relative permittivitty of the ferroelectric is set equal to or greater than 10.

In accordance with the thirteenth aspect of the present invention, the image forming apparatus having any one of the above first through fourth aspects is characterized in that the volume resistivity of the ferroelectric falls within the range from $10^{14}$ Ω•cm to $10^{15}$ Ω•cm.

In accordance with the fourteenth aspect of the present invention, the image forming apparatus having the above thirteenth aspect is characterized in that the volume resistivity of the ferroelectric is set to be equal to or lower than $10^{12}$ Ω•cm when it is heated within the range below the Curie temperature.

In accordance with the fifteenth aspect of the present invention, the image forming apparatus having any one of the above first through fourteenth aspects further comprises a heater for heating the ferroelectric layer arranged close to or in abutment with the ferroelectric layer.

In accordance with the sixteenth aspect of the present invention, the image forming apparatus having any one of the above first through fifteenth aspects further comprises: a potential detector for detecting the surface potential of the transfer device.

In accordance with the seventeenth aspect of the present invention, the image forming apparatus having the above sixteenth aspect is characterized in that based on the detected signal from the potential detector, the ferroelectric is heated under control up to the Curie temperature by the heater.

In accordance with the eighteenth aspect of the present invention, the image forming apparatus having any one of the above first through fourteenth aspects further comprises an erasing portion for erasing the charge on the ferroelectric layer.

In accordance with the nineteenth aspect of the present invention, the image forming apparatus having the above eighteenth aspect is characterized in that the erasing portion is a conductive brush arranged in abutment with the transfer device.

In accordance with the twentieth aspect of the present invention, the image forming apparatus having the above eighteenth aspect is characterized in that the erasing portion is a conductive roller having a conductive surface arranged in abutment with the transfer device.

In accordance with the twenty-first aspect of the present invention, the image forming apparatus having any one of the above eighteenth through twentieth aspects is characterized in that the erasing portion is grounded.

In accordance with the twenty-second aspect of the present invention, the image forming apparatus having any one of the above first through twenty-first aspects is characterized in that the transfer device is provided in a roller configuration which is comprised of a metal core, an electrically conductive elastomer as the first coating layer formed on the metal core surface and a ferroelectric layer as the second coating layer formed on the first coating layer.

In accordance with the twenty-third aspect of the present invention, the image forming apparatus having any one of the above first through twenty-first aspects is characterized in that the transfer device is provided in a roller configuration which is comprised of a metal core and a ferroelectric layer as the first coating layer formed on the metal core surface.

In accordance with the twenty-fourth aspect of the present invention, the image forming apparatus having the above twenty-second or twenty-third aspect is characterized in that the metal core is an aluminum core and the surface thereof in contact with the ferroelectric layer is anodized.

In accordance with the twenty-fifth aspect of the present invention, the image forming apparatus having any one of the above twenty-second through twenty-fourth aspects is characterized in that the transfer device is configured so that an abrasive-resistant material covers or coats the surface layer of the ferroelectric.

In accordance with the twenty-sixth aspect of the present invention, the image forming apparatus having any one of the above twenty-second through twenty-fifth aspects is characterized in that the surface potential in the ferroelectric layer of the transfer device is uniformly electrified at a potential within the range from +200 V to +1600 V, by a dipole orienting treatment.

The present inventors hereof have earnestly studied and successfully provided a transfer device for transferring the toner image formed on the surface of the image bearer, i.e., photosensitive member, from the photosensitive member to transfer medium (such as paper, OHP sheet etc.), in which a dipole oriented (poled) layer, e.g., a ferroelectric layer in the present invention, is formed on the surface layer in abutment with the photosensitive member with the transfer medium in between so that the charged toner adhering to the photosensitive member is made to transfer to the transfer medium by the function of the electric field formed by the dipoles of the transfer roller of the present invention, to thereby provide a recorded image. Thus, the present inventors have successfully completed the invention of a transfer roller which is suitable for this novel transfer process.

DESCRIPTION OF THE PREFERRED EMBODIMENTS

Figure 1A:
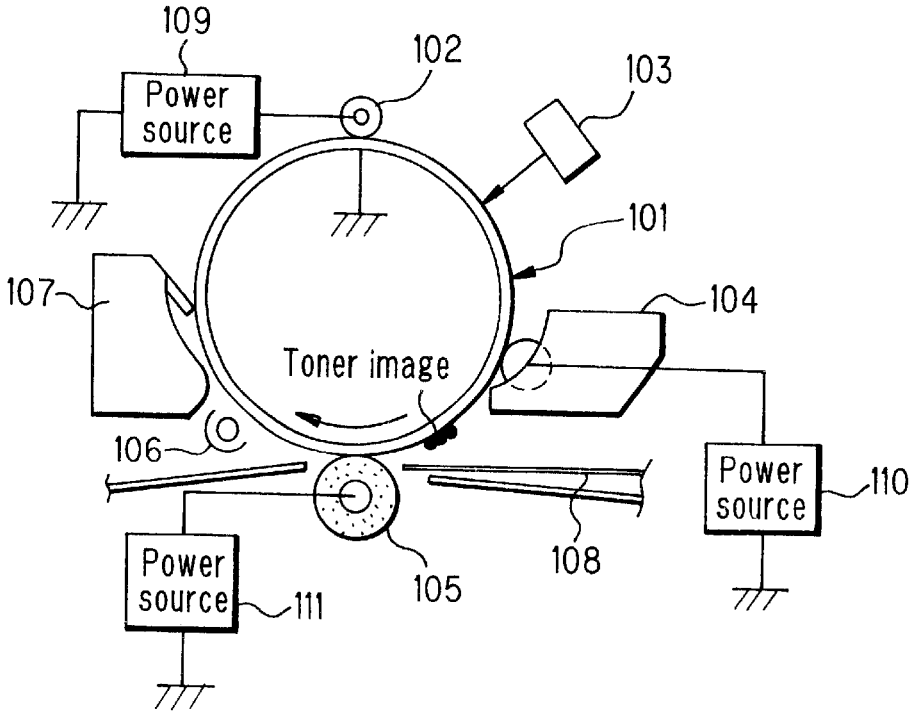
FIG. 1A PRIOR ART
FIGS. 1A and 1B are diagrams showing the configuration of a conventional image forming apparatus.

The embodiments of imaging forming apparatus according to the present invention will hereinafter be described in detail.

The configuration of this imaging forming apparatus is basically the same as the conventional configuration, except in that no power supply for bias voltage application is needed for the transfer device. This transfer device will be described in the following.

This transfer device is configured of a transfer roller as in the conventional configuration and its surface is formed with a ferroelectric layer. The ferroelectric layer is made up of molecules of permanent electric dipoles so as to present spontaneous polarization. Ferroelectrics can be classified into two main groups, order-disorder and displacive, according to the mechanism of formation of spontaneous polarization.

The order-disorder class of ferroelectrics includes substances which transit between the ferroelectric and paraelectric phases as the ordering of the dipole orientation varies. In the ferroelectric phase, since adjacent permanent dipoles are oriented orderly so as not to cancel their dipole moments, the material exhibits spontaneous polarization. In the paraelectric phase, dipole orientation becomes disorder and dipole moments cancel out each other, so that the ferroelectricity disappears resulting in non-polarization. In this way, the dipole orientation is determined by certain combination of the degree of the tendency of adjacent dipoles to be aligned with each other and that of their entropic tendency to become disordered.

Examples of the organic material may include: polymers of vinylidene fluorides, other resins having intermolecular hydrogen bonds therein and containing organic compounds with amino-groups and carbonyl groups, cyano-groups, or thiocarbonylgroups. In the resin, amino-groups and carbonyl groups, cyano-groups, or thiocarbonyl groups (hereinbelow referred to as "functional groups") may exist at the principal chain or side-chains.

Of the resins having these functional groups, resins containing one class of functional group or resins containing two or more classes of functional groups may be used.

Specific examples of materials forming an organic ferroelectric layer include: poly vinylidene fluoride, vinylidene fluoride-tetrafluoroethylene copolymers, vinylidene fluoride-trifluoroethylene copolymers, polyamides having hydrocarbon chains with an odd number of carbon atoms, polyurethanes having hydrocarbon chains with an odd number of carbon atoms, polyureas having hydrocarbon chains with an odd number of carbon atoms, polythioureas having hydrocarbon chains with an odd number of carbon atoms, polyester, polyacrylonitrile, acrylonitrile-methyl metacrylate copolymer, acrylonitrile-allylcyanide copolymer, polyvinyl-trifluoroacetate, polyethernitrile.

Ferroelectrics of the displacive class have spontaneous polarization because the center of the positive ion is displaced from the center of the negative ion by a certain small distance. This displacement is small compared to the dimensions of the unit cell. In paraelectric phase, the ferroelectric presents non-polarity because the centers of positive and negative ions coincide with each other. Such a displacement between ions occurs due to long-distance interaction resulting from the Coulomb force between dipoles at a transition temperature or below. A ferroelectric of inorganic metal oxide material is given as a general form of $[(Bi_2O_2)^{2+}(XY_2O_7)^{2-}]$ (where X represents Sr, Pb or $Na_{0.5}$ $B_{0.5}$ and Y represents Ta or Nb) or given in a general form of $[X_nBi_4Ti_{n+3}O_{3n+12}]$ (where X represents Sr, Pb, Ba, $Na_{0.5}$ $B_{0.5}$ and n represents 1 or 2). Barium titanate is a specific example of this.

A voltage which can produce an electric field in strength greater than the coercive field(which is an external electric field having a strength equal to or greater than a certain level so as to cause polarization and varies depending on the constituent polymer, composition, crystallinity, film thickness, ambient atmospheric temperature etc.) is applied to the ferroelectric having pyroelectricivity, spontaneous polarization and inversion polarization (either by a contact method using roller charging or non-contact method using corona charging) so as to align the permanent dipoles in one direction. This process is called dipole orienting treatment (to be referred to hereinbelow as "poling treatment").

Once poling treatment has been carried out, a constant level of potential, oriented in a constant direction may be maintained semipermanently unless an electric field equal to or greater than the coercive field is applied externally.

In order to cause the permanent dipole thus poled in this ferroelectric element to present a pyroelectric surface potential, the whole surface of the ferroelectric element is heated to a particular temperature (a temperature below the Curie temperature (140° C.), specifically about 100° C., in the present invention, though different depending upon the constituent polymer of the ferroelectric). Then, the ferroelectric element is cooled to room temperature, and the surface potential attributed to the polarized charge of permanent dipoles can be detected on the ferroelectric element surface.

Figure 2:
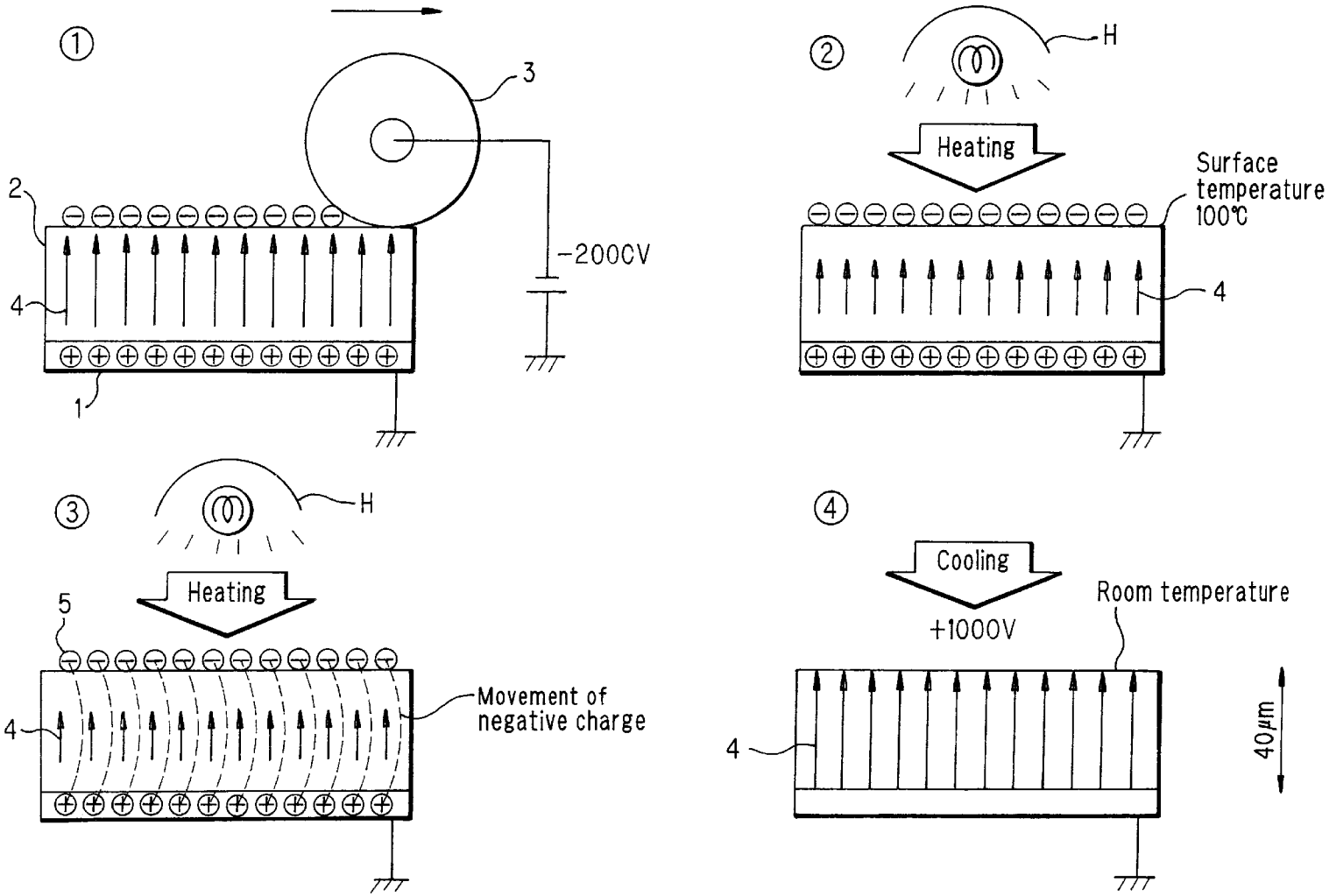
FIG. 2 is an illustrative view showing forming permanent dipoles in a ferroelectric of a transfer device of an image forming apparatus of the present invention.

This process will be described in more detail with reference to ① to ④ in FIG. 2.

① In order to positively electrify a ferroelectric element 2 formed on a conductive support substrate 1, a charging roller 3 negatively biased (at about −2000 V) is set into contact with the ferroelectric element to charge it (for poling treatment). After this, since the polarization charge is neutralized by the real charge on the ferroelectric element surface, the apparent surface potential on the ferroelectric presents a small value.

② The entire surface of ferroelectric element 2 is heated to 100° C. by a heater H.

This heating partially breaks the orientation of permanent dipoles 4, the apparent magnitude of permanent dipoles 4 becomes small.

③ Real surface charge 5 unbalanced by the partially broken orientation charge of permanent dipoles 4 leaks out to conductive support substrate 1 as the volume resistivity of ferroelectric element 2 lowers due to heat (from $10^{14}$ to $10^{15}$ Ω•cm at room temperature to $10^{12}$ Ω•cm or below after heating at 100° C.).

④ Cooling to room temperature makes permanent dipoles 4 restore their original poled state. Since the real charge on the surface of ferroelectric element 2 has been canceled by leaking, it does not balance permanent dipoles 4 so that an arbitrary surface potential resulting from permanent dipoles 4 appears.

In the experiment carried out by the present inventors, the film thickness of ferroelectric element 2 was set at 40 μm and a surface potential of +1000 V was obtained. This surface potential may be adjusted arbitrarily by varying the parameters such as charging conditions, the material of ferroelectric, film thickness and other factors.

Figure 3:
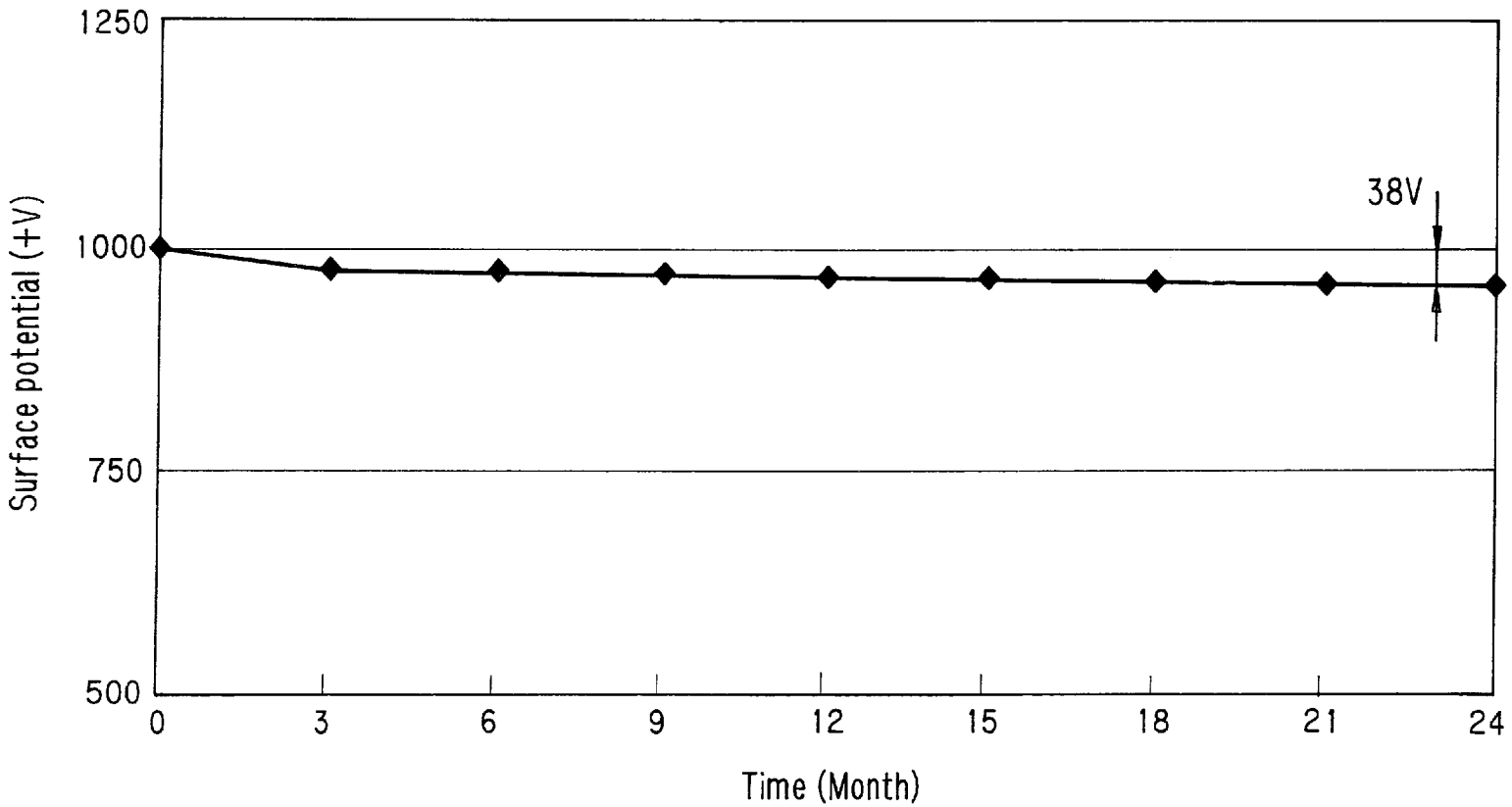
FIG. 3 is a graph showing the variation of the surface potential of a ferroelectric after poling with the passage of time.

FIG. 3 shows the relationship of the surface potential of the ferroelectric versus time, determined by allowing the ferroelectric thus obtained by the above process to stand.

From FIG. 3, despite the fact that the ferroelectric has been left at room temperature for a long period, specifically, two years, it was found from the measurement of the surface potential that only about 38 V had dropped after two years. Further, the transfer test using the above ferroelectric proved out to provide good images free from practical usage problems.

This ferroelectric element 2 presenting an arbitrary surface potential was formed on a roller-shaped conductive support substrate 1 to provide a roller, which was used as a transfer roller and arranged at a potential difference, set against, the photosensitive member bearing the toner image. It was confirmed experimentally that the toner image could be statically transferred to the transfer medium by using this potential difference.

The main feature of this process is that the surface potential arising on the ferroelectric element is maintained semipermanently so that no high-voltage power source is needed for the transfer roller, whereby beneficial transfer can be performed without any necessity for external voltage application.

Figure 1B:
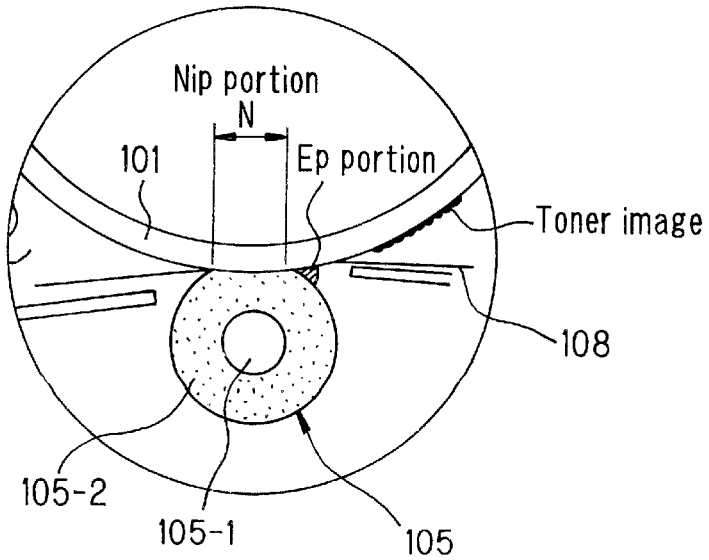
FIG. 1B PRIOR ART

The advantage of using this process was also confirmed by the following point. That is, since the volume resistivity of a ferroelectric element at room temperature is as high as $10^{14}$ to $10^{15}$ Ω•cm, no Paschen discharge occurs at the micro gap near the entrance to the transfer nip Eg (FIG. 1B) hence no ozone will arise.

Figure 4:
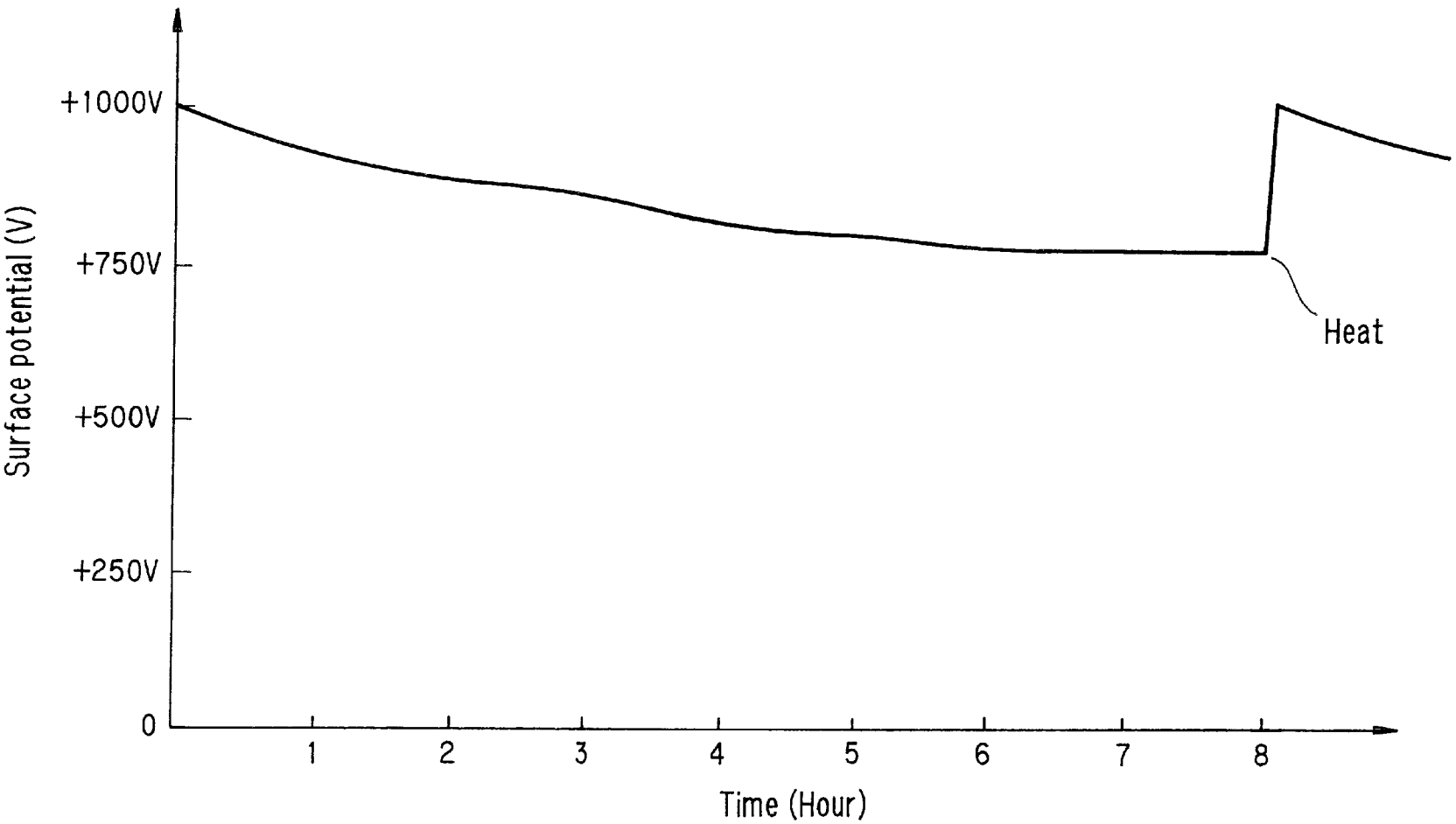
FIG. 4 is a graph showing the variation of the surface potential of a ferroelectric with the passage of time.

The ferroelectric layer having a surface potential of +1000 V, thus obtained from the above process, was shaped into a transfer roller, which was installed in an image forming apparatus and evaluated. First, in the experiment for evaluating the attenuation in potential at the transfer roller surface, the photosensitive member uniformly charged at −600 V was set against the transfer roller and rotated. FIG. 4 shows the time-dependent variations of the surface potential on the transfer roller.

From FIG. 4, the surface potential of this transfer roller turned out to attenuate by about 240 V after a 8 hour continuous drive of rotation. It was further confirmed that the surface potential of the transfer roller could be restored to the initial potential by heating the transfer roller with a heater.

The transfer roller was heated at a heating temperature of 100° C., which is below the Curie temperature. However, depending on the method of heating the ferroelectric (internally or externally), there may be cases where heating should be done at a further lower temperature taking into account damage to the photosensitive member. That is, the temperature should not be particularly limited and the temperature may be determined as appropriate, considering the heating method of the ferroelectric.

Figure 5A:
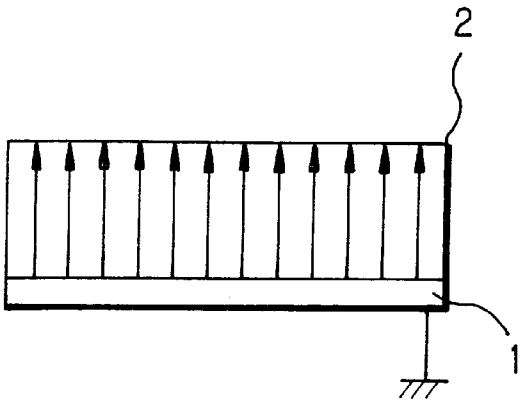
FIGS. 5A, 5B and 5C are diagrams showing various layered configurations of ferroelectrics.
Figure 5B:
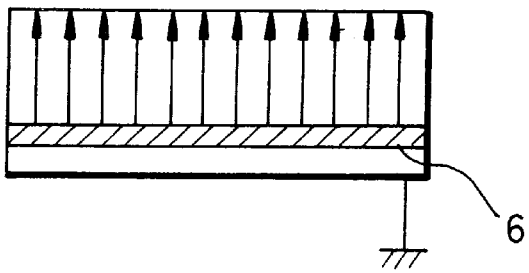
Figure 5C:
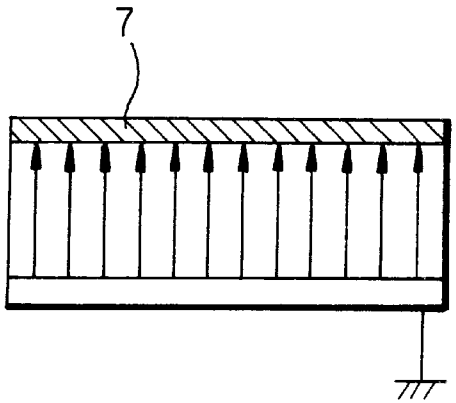

As stated already, the transfer device used in the image forming apparatus of the present invention is comprised of ferroelectric layer 2 and conductive support substrate 1. As shown in FIG. 5, ferroelectric layer 2 and conductive support substrate 1 may be formed in close contact with each other (FIG. 5A) or an intermediate layer 6 may be interposed between ferroelectric layer 2 and conductive support substrate 1 (FIG. 5B). It is further preferred that an abrasive-resistant element 7 (such as polyester, Teflon, nylon resin and the like) may cover the surface layer of the ferroelectric layer or the ferroelectric layer surface may be coated by dissolving an organic powder such as polymethyl butyral, poly-methyl methacrylate or the like, in a volatile solvent and spraying the solvent as a coating agent (FIG. 5C).

Preferred examples of ferroelectric layer 2 are given as follows:

As the organic ferroelectric, vinylidene fluoride-tetrafluoroethylene copolymers [P(VDF-TeFE)], polymerized with the molar percentage of vinylidene fluoride set at 0 to 100 mol % (copolymer with the molar percentage set at 80 mol % was most preferable) or vinylidene fluoride-trifluoroethylene copolymers [P(VDF-TrFE)], polymerized with the molar percentage of vinylidene fluoride set at 0 to 100 mol % may be used. As the inorganic ferroelectric, a ceramics sintered compact composed of three components, namely bismuth-strontium titanate ($SrBi_4Ti_4O_{15}$) may be used. However, ferroelectrics should not be particularly limited and any ferroelectric can be used as long as it has permanent dipoles poled when an electric field equal to or stronger than the coercive field is applied by a charging roller, charging brush, coronal charger or the like and as long as it has the characteristic of presenting a pyroelectric potential at its surface when it is heated at a particular temperature below the Curie temperature by a heater.

Next, the material of conductive support substrate 1 should not be particularly limited and any material can be used as long as it has a necessary mechanical strength and conductivity. In terms of workability and shape stability, adhesiveness to the ferroelectric element, for example, metals such as anodized aluminum($Al_2O_3$), etc., conductive polymers, conductive inorganic substance such as carbon black, and conductive rubbers in which carbon black, a metal oxide, metal powder, ion conducting agent or conducting agent such as graphite has been filled when vulcanized, may be used.

<Production methods of organic ferroelectric elements>

Production methods of organic ferroelectric elements can be basically categorized into three classes as follows:

Class (I): a conductive support layer is formed first, then an organic ferroelectric layer is formed on the support layer;

Class (II): an organic ferroelectric layer is formed first, then a conductive support layer is formed on the organic ferroelectric layer; and Class (III): an organic ferroelectric layer and a conductive support layer are formed separately, then these two are bonded using conductive adhesive, etc.

The organic ferroelectric according to the present invention is basically produced based on the above class (I). This will be described specifically bellow.

However, the production method should not be limited to this, and an optimal production method can be arbitrarily chosen dependent upon the configuration of the transfer device used in the image forming apparatus of the present invention, film thickness forming conditions of the ferroelectric element and other factors. Illustratively, when the transfer device is of a roller or blade type, a dipping method as mentioned below is preferable while roll coating or spray coating is preferable if the transfer device is of a belt type.

Figure 6:
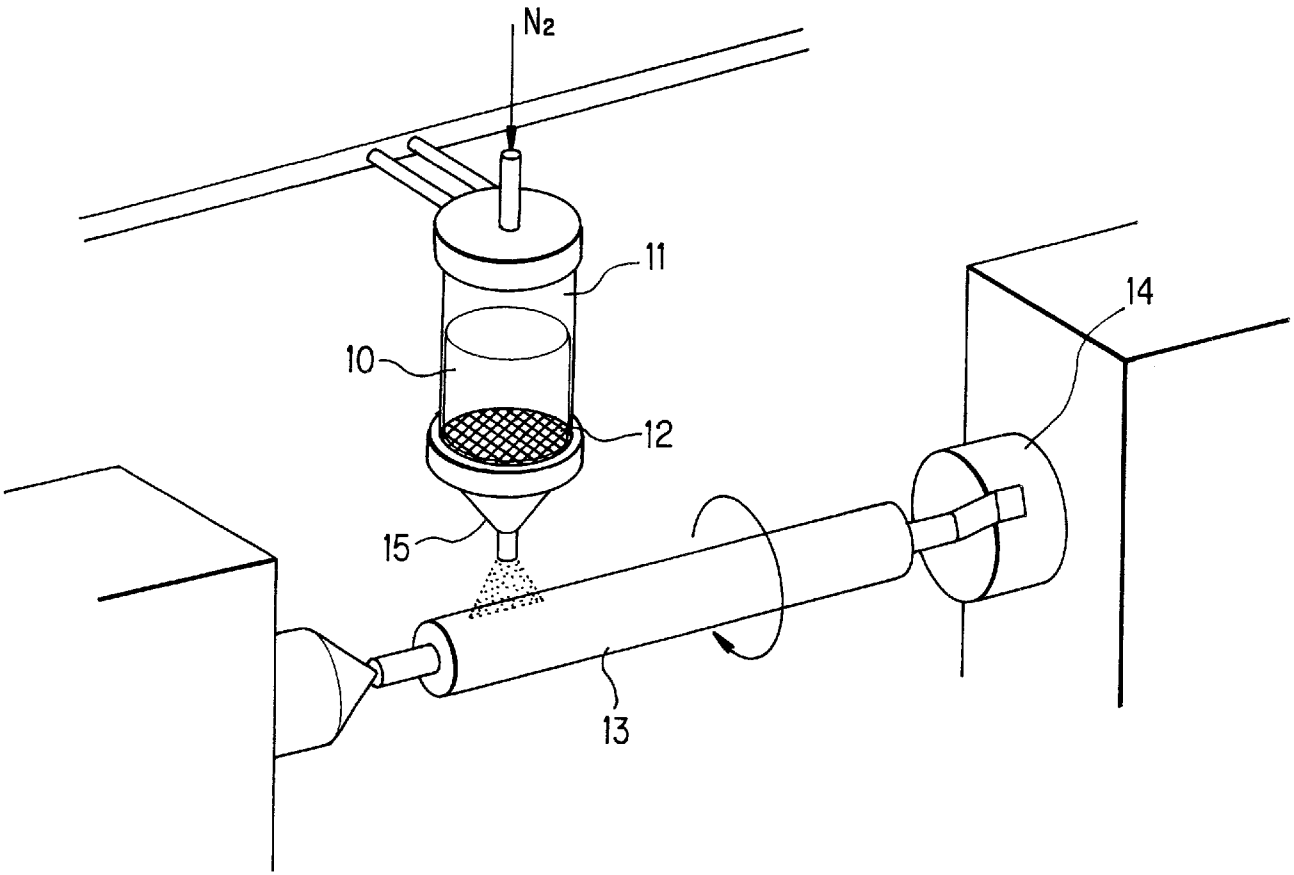
FIG. 6 is an illustrative view showing an example of producing a ferroelectric transfer roller according to the present invention.

One example of the production method of a ferroelectric transfer roller according to the present invention is shown in FIG. 6. FIG. 6 shows an example of a production method by spray coating. The present invention should not be limited to this production method, but an optimal production method can be chosen arbitrarily dependent upon the film thickness forming conditions of the ferroelectric element and other factors.

The specific method for producing a ferroelectric transfer roller is carried out by the following manner.

To begin with, constituent materials of the rubber composition are mixed and kneaded by a kneading machine and then the kneaded material is formed into a tube by an extruder. A metallic core with adhesive applied thereon is inserted into the bore of the tube. The resultant is then inserted into a cylindrical mold so as to undergo vulcanization. During vulcanizing, conductive fillers such as carbon black, foaming agents such as azodicarbonamide and other filler agents are mixed as necessary to form an elastomer presenting an ASKER C hardness of 20 to 60 degrees and a volume resistivity of $10^6$ Ω•cm or below. When vulcanization is completed, an elastomeric roller can be obtained by the process. If the thus obtained elastomeric roller is not solid but spongy, the roller may preferably have a skin layer free from foam on the surface. Here, the ASKER C hardness is the hardness measurement conforming with JIS S6050 and measured by a particular hardness tester of a spring type, which is a product of KOBUNSHI KEIKI CO., LTD.

Next, this elastomeric roller 13 is attached to a rotary jig 14 and placed in an atmosphere of acetone vapor, as shown in FIG. 6.

Next, the material constituting the organic ferroelectric (a copolymer of vinylidene fluoride and tetrafluoroethylene or trifluoroethylene, polymerized in a particular molar ratio) is dissolved in a solvent such as acetone to prepare a solution 10. This solution 10 is charged into a container 11 having a spray gun 15. A membrane filter 12 having holes of 5 μm in diameter is provided in container 11 with spray gun 15, so that the solution may be pressure filtrated through membrane filter 12 and sprayed under a high-pressure gas such as nitrogen gas etc.

Spray gun 15, as it adapted to feed along the axis of elastomeric roller 13, applies sprays of solution 10 uniformly to the surface of elastomeric roller 13 which is set in rotary jig 14 and rotationally driven at a predetermined number of rotations.

After the completion of application, the roller is heated for one hour at 133° C. in a heating furnace (Yamato DN64 thermostat). Because the ferroelectric element obtained by the production method herein has a complex higher-order structure, with a mix of crystalline and noncrystalline portions, if used directly, the degree of crystallization is too low to present adequate ferroelectricity. However, the heat treatment markedly increases the degree of crystallization so that the ferroelectric element can provide necessary ferroelectricity. This is why the heat treatment should be done. The temperature for this heat treatment may and should be set at a temperature between the melting point (Tm) of the ferroelectric polymer and the Curie temperature (Tc). Though the heat treatment is done at 133° C. for one hour in the above description, the heat treatment should not be limited by this condition. That is, the temperature and heating time may be adjusted to the conditions suitable for the ferroelectric polymer to be used.

To control the film thickness of the ferroelectric, the rotational frequency of rotary jig 14 may be controlled and the sprayed amount of solution 10 may be adjusted. It is possible to arbitrarily control the film thickness of the ferroelectric by adjusting the time of the spray and other factors. In the experiment, the necessary thickness of the ferroelectric layer was about 40 μm, which was determined based on the relationship with the surface potential after poling.

Other than the above, there are several production methods of ferroelectric transfer rollers. One method, for example, comprises the steps of evaporating monomers constituting an organic ferroelectric layer in vacuum, polymerizing them on the transfer roller surface. Another method may comprise the steps of dissolving the monomers in a solvent, applying the resulting solution to the transfer roller surface by dipping, bar-coating, roll-coating or the like, then heating to fuse it and rapidly cooling it. Further, a ferroelectric polymer solution may be deposited by vapor deposition, sputtering or the like.

Figure 7:
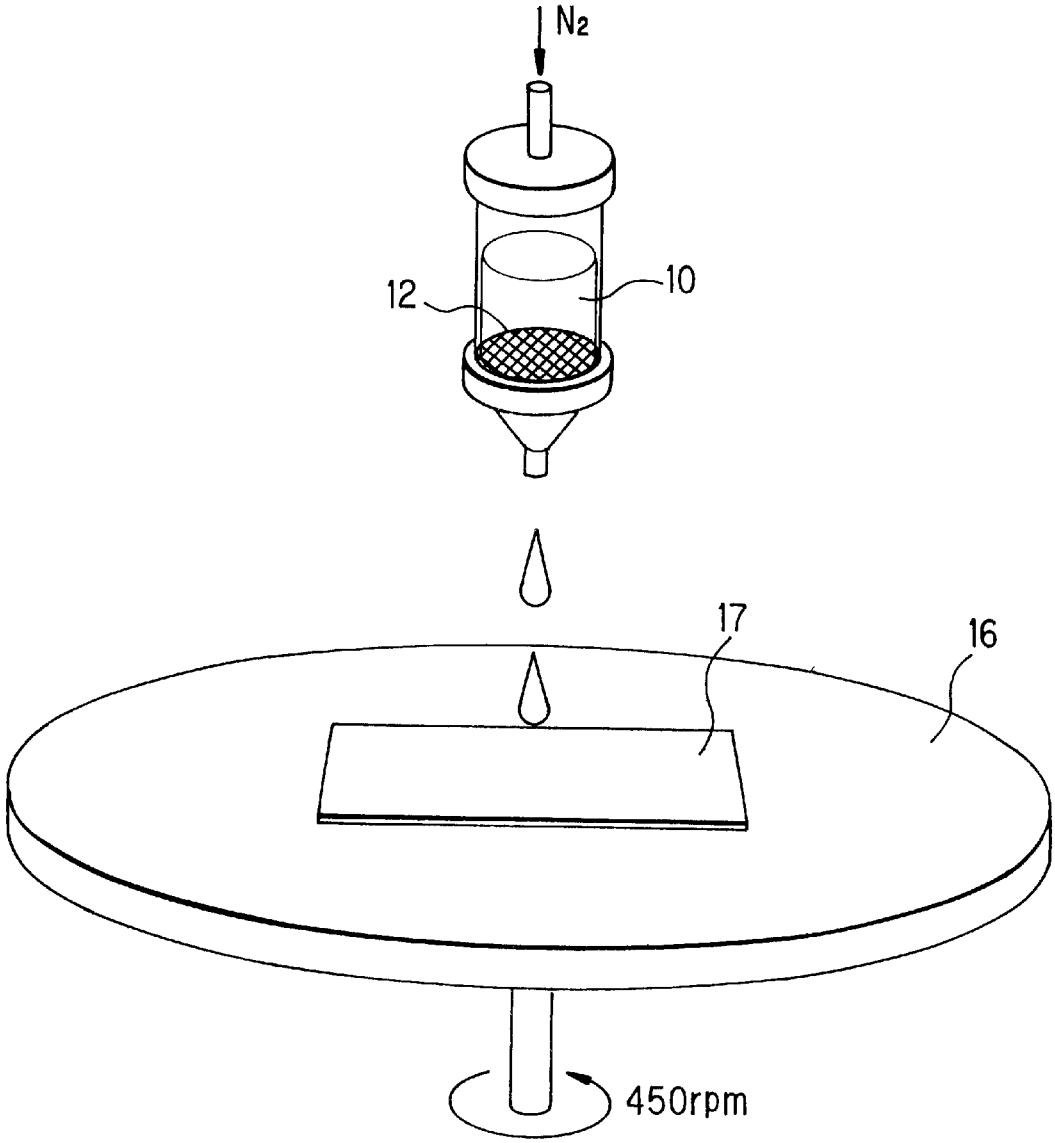
FIG. 7 is an illustrative view showing another example of producing a ferroelectric transfer roller according to the present invention.

FIG. 7 shows another example of a production method of a ferroelectric transfer roller according to the present embodiment. In FIG. 7, the material constituting an organic ferroelectric (a copolymer of vinylidene fluoride and tetrafluoroethylene or trifluoroethylene, polymerized in a particular molar ratio) is dissolved in a solvent such as acetone to prepare a solution 10. This solution 10 is pressure filtrated through membrane filter 12 having holes of 5 $\mu$m in diameter using nitrogen gas. The thus filtrated solution is applied dropwise to a conductive substrate 17 (having an arbitrary shape suitable as the transfer device: in the present invention, for example, a film made of a flexible synthetic resin with a conducting agent such as carbon black dispersed therein, or a belt made of a synthetic resin with a conducting agent such as carbon black dispersed therein) fixed on a rotary disc being rotated at about 450 rpm by a spin coater 16 (MANUAL SPINNER ASS-30, a product of ABI-E Corp.) placed in an atmosphere of acetone vapor, so that the solution is spin coated by centrifugal force. Then the resultant is heated at 133° C. for one hour in a heating furnace (Yamato DN64 thermostat).

Because the ferroelectric element obtained by the production method herein has a complex higher-order structure, with a mix of crystalline and noncrystalline portions, if used directly, the degree of crystallization is too low to present adequate ferroelectricity. However, the heat treatment markedly increases the degree of crystallization so that the ferroelectric element can provide necessary ferroelectricity. This is why the heat treatment should be done. The temperature for this heat treatment may and should be set at a temperature between the melting point (Tm) of the ferroelectric polymer and the Curie temperature (Tc). Though the heat treatment is done at 133° C. for one hour in this embodiment, the heat treatment should not be limited by this condition. That is, the temperature and heating time may be adjusted to the conditions suitable for the ferroelectric polymer to be used.

The reason for spin coater 16 being used is that control of the film thickness of the ferroelectric is easily made. That is, controlling the rotational speed of spin coater 16 enables the film thickness of the ferroelectric to be adjusted arbitrarily. The necessary thickness of the ferroelectric layer was about 40 $\mu$m, which was determined based on the relationship with the surface potential after poling. This film thickness could be obtained by setting the rotational speed of spin coater 16 at about 450 rpm. If a thicker film is needed, the rotational speed of spin coater 16 may be reduced. On the contrary, if the film thickness is reduced to sub-micron order, the rotational speed may be increased.

There are several other production methods of ferroelectrics of class (I) than the above. One specific method comprises the steps of evaporating monomers constituting an organic ferroelectric layer in vacuum, polymerizing them on the conductive support layer. Another method may comprise the steps of dissolving the monomers in a solvent, applying the resulting solution to the conductive support layer by dipping, bar-coating, spin-coating, roll-coating, spray-coating or the like, then heating to fuse it and cooling it rapidly. Further, a ferroelectric polymer solution may be deposited by vapor deposition, sputtering or the like.

For the conductive support layer, a metal or conductive organic material may be directly used. Alternatively, conductive plastic, conductive rubber and any other insulative substrate in which conductive material is dispersed to give conductivity may be used. That is, any material can be used as long as it presents conductivity and the necessary mechanical strength.

As the production methods of class (II) as categorized above, some specific methods can be mentioned. One method of film forming, for example, comprises the steps of dissolving the material constituting an organic ferroelectric in a solvent, applying the resulting solution to a substrate by dipping, bar-coating, roll-coating, spray-coating, or spin-coating, or depositing the material on a substrate by vapor deposition, sputtering as mentioned before, then heating to fuse it, cooling it rapidly, separating the formed film from the substrate, and subjecting the resultant film, as required, to treatments such as drawing, heating or the like, for providing the necessary ferroelectricity. Another method of film forming comprises the steps of pressing the material constituting an organic ferroelectric layer whilst heating and fusing it to form a film, then cooling the film rapidly, and subjecting it, as required, to treatments such as drawing, heating or the like, for providing the necessary ferroelectricity.

The conductive support layer can be produced by forming a conductive material on the organic ferroelectric layer by application, vapor deposition, ion-coating, or other methods.

As the production methods of class (III) as categorized above, the ferroelectric layer obtained by the production method of class (II) and a substrate such as metal or conductive organic material may be bonded using a conductive adhesive.

<Production methods of inorganic ferroelectric elements>

Production methods of inorganic ferroelectric elements can be roughly categorized into two classes as follows:

Class (A): a conductive support layer is formed first, then an inorganic ferroelectric layer is formed on the support layer; and Class (B): an inorganic ferroelectric layer and a conductive support layer are formed separately, then these two are bonded.

The inorganic ferroelectric element according to this embodiment is basically produced by the production method of class (A). This will be described specifically. However, the present invention should not be limited to this method.

Next, one example of the production method of an inorganic ferroelectric element of the present invention will be described below.

First, 0.763 g of strontium carbonate($SrCO_3$), 1.652 g of titanium oxide($TiO_2$) and 4.818 g of bismuth trioxide ($Bi_2O_3$) are mixed sufficiently, and the mixture is sintered at 890° C. for one hour using an electric furnace. The mixture after sintering is grounded in a mortar so as to provide a $SrBi_4Ti_4O_{15}$ powder.

A mixture made up of 50% $SrBi_4Ti_4O_{15}$ powder thus obtained, 2.5% polyvinylbutyral (S-LEC BX-L, a product of SEKISUI CHEMICAL CO., LTD), 47.5% methylethylketon is dispersed and mixed for one hour using ball milling.

The thus obtained dispersed mixture liquid is applied on a conductive substrate(platinum etc.) using a bar coater so that the film thickness will be 40 $\mu$m after drying. Then this is heated and dried at 60° C. for three hours and sintered at 1000 to 1200° C. to form a ferroelectric layer. Thus, the necessary ferroelectric element can be obtained.

There are several production methods other than that of class (A) above. One method of forming a ferroelectric layer, for example, comprises the steps of mixing and dissolving a ferroelectric material and a resin in a solvent, applying the mixed solvent on a conductive substrate by dipping, roll-coating, spray-coating, spin-coating or the like, then removing the solvent. Another method of forming a ferroelectric layer may comprise the steps of dispersing ferroelectric particles in an acetone solution with iodine added thereto and forming a film by electro-deposition. A further method of laminating a ferroelectric may comprise the step of laminating a ferroelectric on a support layer by magnetron sputtering method, laser application method, inorganic metal complex decomposition method (MOCVD) as a chemical vapor deposition or sol-gel processing.

As the production methods of class (B) categorized as above, the ferroelectric element may be formed by forming a ferroelectric film by a solid phase reaction or other method and bonding the film to a support layer using a conductive adhesive. Examples of the resin material to be used for forming a ferroelectric layer include polyvinyl acetal, polyester, polycarbonate, epoxy resin, polymethyl methacrylate or the like.

The solvent to be used for the mixture solution forming the ferroelectric layer is a solvent which will not affect inorganic oxide ferroelectrics. Any solvent may be used as long as it can dissolve or disperse the above resin materials. Examples of the solvent include ketone type solvents, chlorine type solvents, aromatic polar solvents.

The ferroelectric elements thus obtained (in a film configuration or preferably in a seamless tubular configuration) by the above various production methods are used to coat, or are bonded over a roller-shaped support substrate, to form a transfer roller.

Thereafter, the ferroelectric element is subjected to poling and heating by roller contact charging etc., as mentioned above so that the element may exhibit the desired pyroelectric potential.

The production process may be performed in the reverse order. That is, the same performance can be obtained by causing the ferroelectric element to exhibit the desired pyroelectric potential first and then coating or bonding it over the roller-shaped support substrate.

As to the charging process of the ferroelectric element, charging may be performed by bringing a conductive rubber roller to which a high voltage is being applied into contact with the ferroelectric layer and applying a voltage greater than some hundreds of volts to the conductive rubber roller having a resistivity of about $10^5$ to $10^9$ Ω•cm, or may be performed by providing brushy, fine fibers having a resistivity of about $10^3$ to $10^5$ Ω•cm on a conductive roller surface and bringing it into enhanced contact with the ferroelectric element. Alternatively, charging may be performed by applying pulsing corona discharges using a corona charger.

At to the heating process, heating may be performed by heat irradiation from a xenon lamp, halogen lamp, etc., by bringing a sheet-like heater into contact, by a high-power laser, by bringing a heat roller into contact or the like.

[Embodiments]

Next, the embodiments of the present invention will be described with reference to the drawings.

<Embodiment 1>

FIG. 8 shows the basic configuration of embodiment 1 of an image forming apparatus according to the present invention.

Figure 8A:
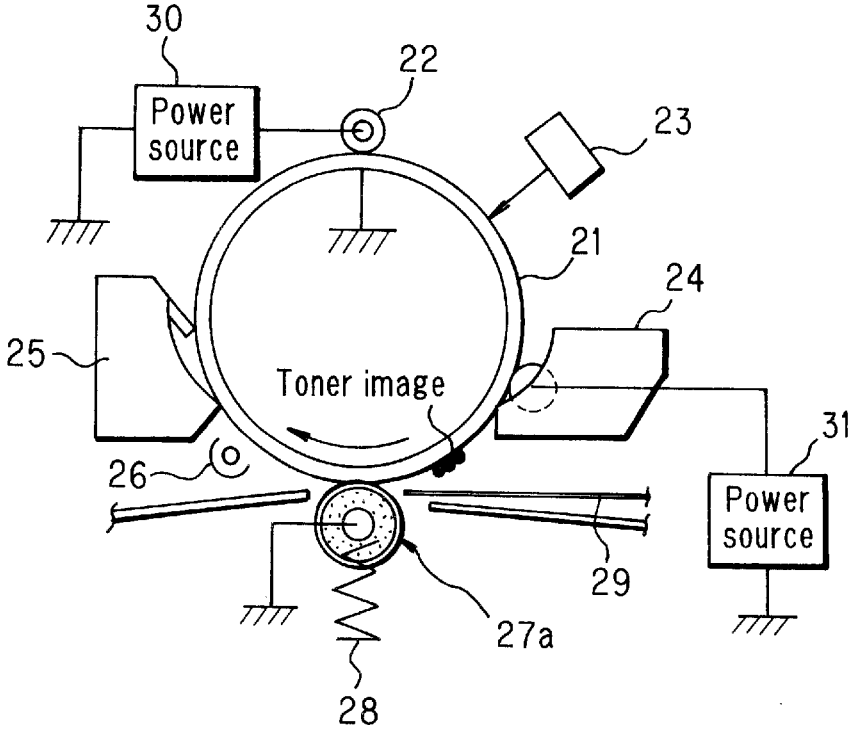
FIGS. 8A and 8B are diagrams showing the configuration of embodiment 1 of an image forming apparatus of the present invention.

In FIG. 8A, the image forming portion has a grounded, drum-shaped photosensitive member 21 (having an outer diameter of 30 mm) rotating in the direction of the arrow. Arranged around photosensitive member 21 are a charger 22, exposure unit 23, developing unit 24, cleaning unit 25, erasing unit 26 and transfer roller 27*a* (having an outer diameter of 18 mm) with a ferroelectric layer of the present invention formed on the surface thereof. Here, transfer device 27*a* is of a roller configuration but may be of a belt or blade configuration.

Photosensitive member 21 is charged at a particular potential (at −600 V in the present invention) by charger 22 and exposed by exposing unit 23 so that a static latent image in accordance with the image data is formed on the photosensitive member. The surface potential at exposed areas in the static latent image on photosensitive member 21 is attenuated to approximately 0 V. The toner, negatively charged in developing unit 24 is statically attracted to the exposed areas to create a developed image. The toner image area after image development has a surface potential of −200 V.

Figure 8B:
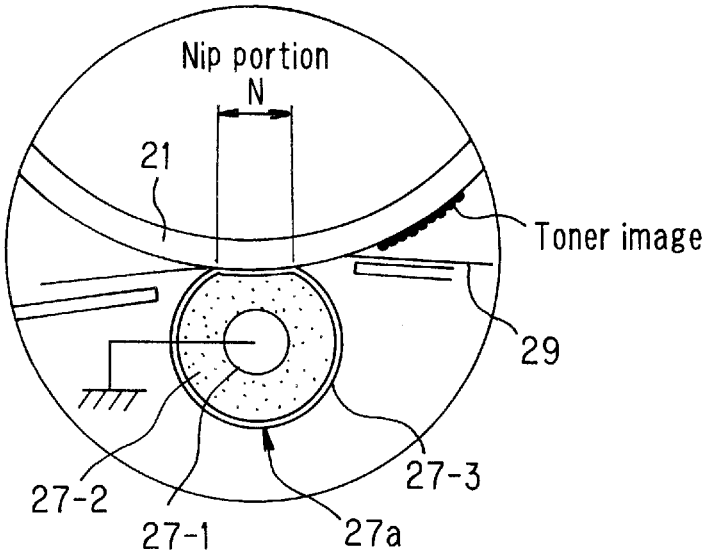

As shown in FIG. 8B, this ferroelectric laminated transfer roller 27*a* is comprised of a grounded metal core 27-1 of aluminum, a conductive rubber layer (of an elastomer having a volume resistivity of $10^5$ Ω•cm or below with a thickness of 3 mm, molded in a roller-shape) 27-2 formed on the metal core and a ferroelectric element (film) 27-3 having a film thickness of some μm to some tens of micrometers, and overlying the surface of the conductive rubber layer. This transfer roller 27*a* surface was subjected to poling and heating so as to continuously present a uniform pyroelectric potential of some hundreds volts positive potential to some thousands volts positive potential. This transfer roller 27*a* is urged by a spring 28 to come into contact with the photosensitive member surface with a pressure of 1000 g/cm$^2$ or below. This transfer roller is driven, following the rotation of photosensitive member 21 so as to transfer the toner on photosensitive member 21 to a transfer medium 29 whilst conveying a transfer medium 29 through transfer nip portion, designated by N.

The mechanism of toner transfer will be briefly described below. First, as to the polarization charge Q on the ferroelectric layer can be given as follows:

$$Q=(\epsilon\epsilon_0 S/d)V \qquad \text{(formula 1)}$$

where d represents the film thickness of the ferroelectric, ϵ the relative permittivity, and V the pyroelectric surface potential.

This relation can be also applied to photosensitive member 21. That is, Q is the charged amount of electricity, V the surface potential, ϵ the relative permittivity of photosensitive member, d the photosensitive member film thickness. $\epsilon_0$ represents the permittivity in vacuum, S the measured area.

Since the ferroelectric has a large relative permittivity (ϵ: equal to or below 1000), it is understood from the above formula that a large polarization charge (Q) will arise even with a relatively low voltage (V). Further, it is possible to easily create an excessive amount of polarization charge when charged by a high voltage (V). On the other hand, for the photosensitive member, an OPC photosensitive member has a relative permittivity of 3, and even an a-Si photosensitive member has as small a relative permittivity as 12. So the amount of charge on the photosensitive member is relatively small even if the photosensitive member is set at the same potential as that of the ferroelectric.

Since photosensitive member 21 is limited by its withstand voltage (usually up to 3 kV), the amount of charge formed thereon is also limited by an upper boundary. Accordingly, when a ferroelectric is used, it is easily possible, in usual, to create polarization charge much higher than the charge formed on photosensitive member 21. Therefore, a large electric field extends externally from the ferroelectric, hence it is possible to create an electric field which is able to easily provide an arbitrary static attraction much greater than the attraction of the toner image to photosensitive member 21.

In this image forming apparatus, fundamental experiments for statically attracting the negatively charged toner by the electric field formed by dipoles were carried out using a ferroelectric element positively pyroelectrified by poling and heat treatments.

As a result, with the pyroelectric potential of the ferroelectric set at +1000 V, the optimal transfer was obtained when the film thickness of the ferroelectric was 40 μm. Though the pyroelectric potentials differed from one another depending on the materials forming the ferroelectrics, the potential increased in proportion to the film thickness. Usually, a 25 V increase in pyroelectric potential can be obtained for every 1 μm thickness.

This experiment presented satisfactory result with a transfer efficiency of 94.6%, an image density value ID of 1.2 and no generation of ozone. As already mentioned, no Paschen discharge occurred at the micro gap near the nip portion N between transfer roller 27 and photosensitive member 21. In this experiment, because of this nonoccurence of Paschen discharge around the micro gap area, it was found that the toner did not scatter while transferring to the transfer medium, or no toner scattering occurred, which would have occurred in the conventional configuration. Accordingly, the configuration of this experiment turned out to be able to produce high quality images excellent in dot reproducibility free from toner scatter.

The result obtained from this experiment is summarized in Table 1 below.

TABLE 1

| Surface Potential of Ferroelectric (+V) | 200 | 400 | 600 | 800 | 1000 | 1200 | 1400 | 1600 |
|---|---|---|---|---|---|---|---|---|
| Film Thickness of the Formed Ferroelectric (μm) | 7.9 | 16 | 23.5 | 33.1 | 40 | 46.9 | 55.9 | 65.8 |
| Transfer Efficiency (%) | 78.2 | 83.5 | 86.7 | 93.9 | 94.6 | 92.7 | 90.6 | 90.3 |
| Image Density | 1.0 | 1.0 | 1.1 | 1.2 | 1.2 | 1.2 | 1.2 | 1.1 |
| Toner Scatter area ratio (%) | 2 | 2 | 2 | 3 | 3 | 3 | 4 | 4 |
| Ozone Generation Amount (PPM), not including a trace of ozone in the air | 0 | 0 | 0 | 0 | 0 | 0 | 0 | 0 |

For the measurement of the transfer efficiency, an empty suction bottle is weighed using an electronic balance (AT261 Delta Range, a product of METTLER TOLEDO Corp.) first, then the toner having transferred to transfer medium 29 is suctioned into the suction bottle by an aspirator so that the bottle, after suction, is weighed again by the electronic balance.

{The weight (c) of the toner transferred to the transfer medium}={the weight (a) of the suction bottle after suctioning}−{the weight (b) of the empty suction bottle}

Similarly, an empty suction bottle is weighed using the electronic balance, then the leftover toner on photosensitive member 21 is suctioned.

{The weight (e) of the leftover toner on the photosensitive member}={the weight (d) of the suction bottle after suctioning}−{the weight (b) of the empty suction bottle}

The total amount of the toner developed on photosensitive member 21 by developing unit 24 is given (c+e) mg, so that the transfer efficiency can be given as follows:

$$\text{Transfer Efficiency [\%]}=c/(c+e)\times 100$$

For the measurement of the image density, 938 Spectro Densitometer (a product of X-Rite Corp.) was used.

The toner scatter area was determined using the following relation:

(Toner scatter area ratio)=(Total toner scatter area per 1 $cm^2$ in the BG portion)×100.

When the toner scatter area ratio was 5% or below, the image was beneficial under visual observation. As the device for image evaluation for calculating the toner scatter area ratio, SPECTRUM (II), a product of MITANI CORPORATION, was used as an image processing board, NEC PC-9821AP2 as a post machine and MICROWATCHER VS-20F as a magnifier microscope.

For the measurement of the ozone amount, an ozone monitor OZM-7000G-3 (a product of SHIBATA KIKAI CORP.) was used. Upon measurement, the trace ozone in the air was measured first. Then, the ferroelectric laminated transfer roller pyroelectrified at each potential was abutted against the photosensitive member and idly run for 30 minutes. The ozone generated from this operation was measured.

<Embodiment 2>

Figure 9:
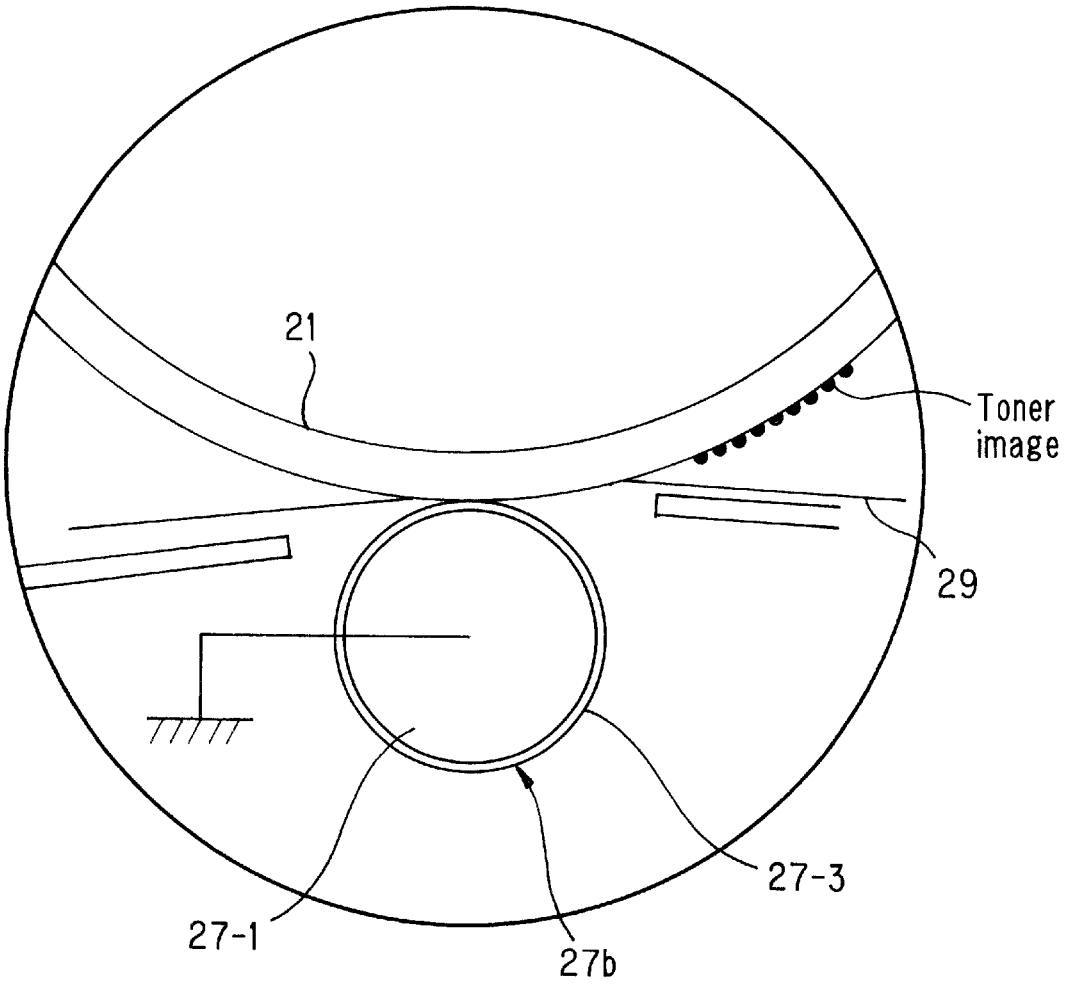
FIG. 9 is a diagram showing the configuration of embodiment 2 of an image forming apparatus of the present invention.

FIG. 9 shows the basic configuration of embodiment 2 of an image forming apparatus according to the present invention.

In FIG. 9, a transfer roller **27*b* was comprised of a metal core 27-1 made of iron, aluminum or the like, a ferroelectric element(film) 27-3** coating over the metal core surface with a film thickness of some μm to some tens of micrometers as a ferroelectric layer.

<Embodiment 3>

Figure 10:
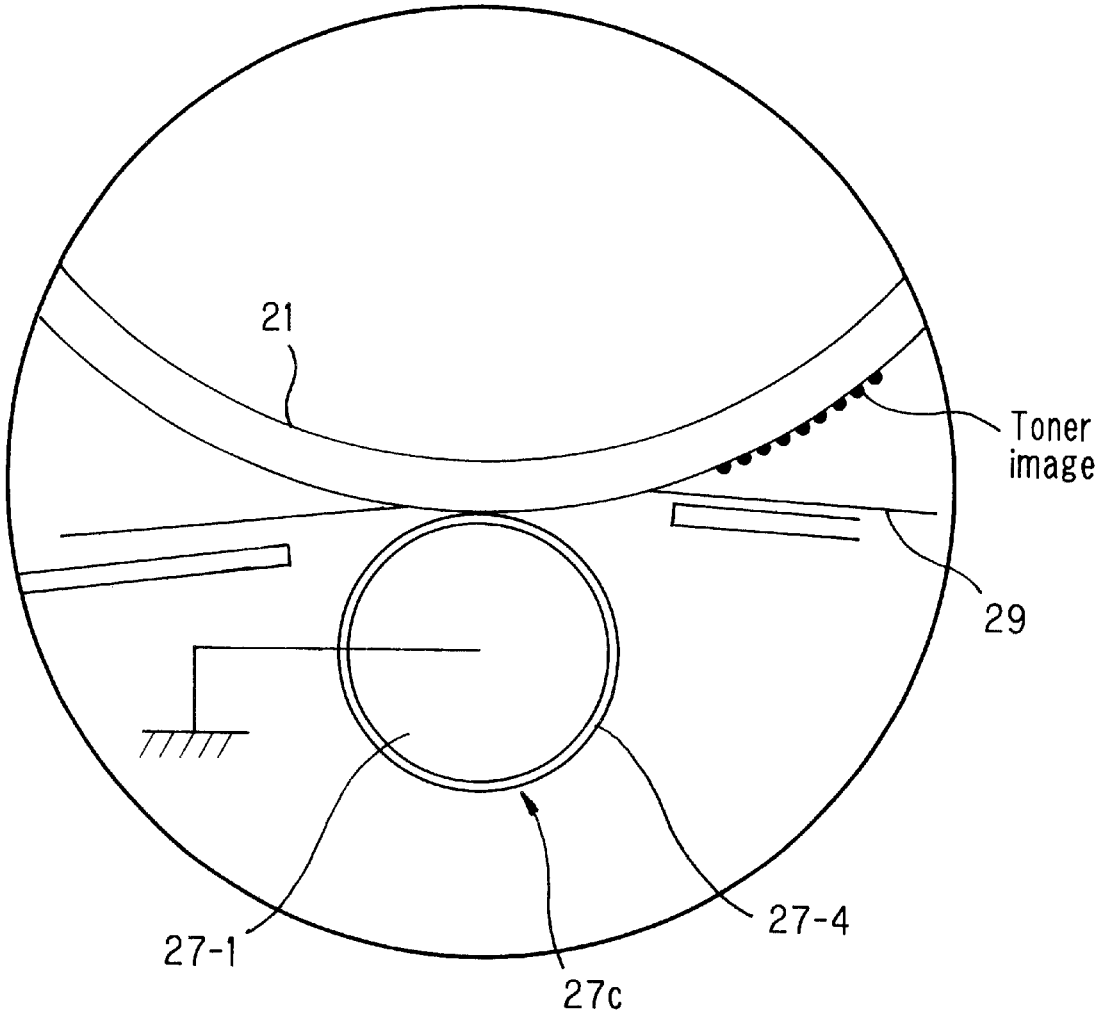
FIG. 10 is a diagram showing the configuration of embodiment 3 of an image forming apparatus of the present invention.

FIG. 10 shows the basic configuration of embodiment 3 of an image forming apparatus according to the present invention.

In FIG. 10, a transfer roller **27*c* was comprised of a metal core 27-1 made of iron, aluminum or the like, the surface of which was coated with a ferroelectric layer 27-4** in a film thickness of some μm to some tens of micrometers.

<Embodiment 4>

Figure 11:
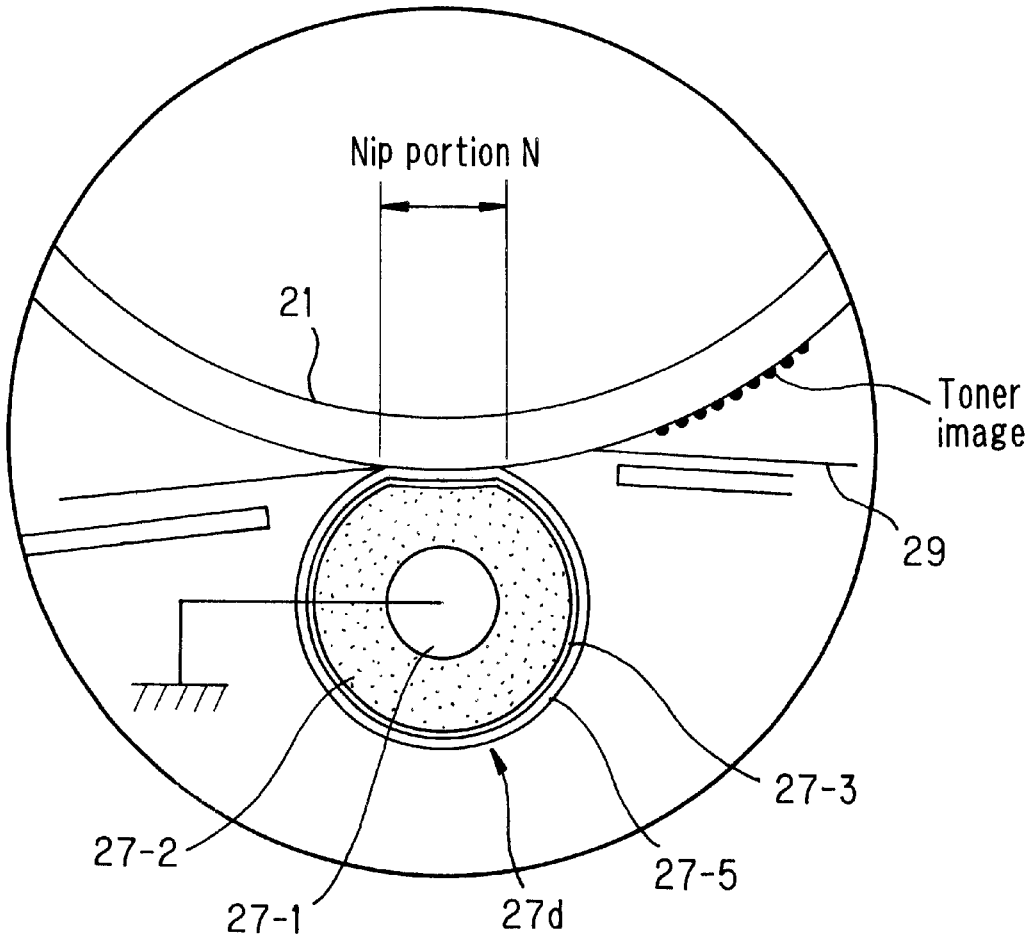
FIG. 11 is a diagram showing the configuration of an embodiment of an image forming apparatus of the present invention.

FIG. 11 shows the basic configuration of embodiment 4 of an image forming apparatus according to the present invention.

In FIG. 11, a transfer roller **27*d* was comprised of a metal core 27-1 made of aluminum, a conductive rubber 27-2 (having a volume resistivity of $10^5$ Ω•cm or below with a thickness of 3 mm, molded in a roller-shape) coating the metal core surface, and a ferroelectric element (film) 27-3 or ferroelectric layer obtained by any of the above production methods, having a film thickness of some μm to some tens of micrometers, coating the surface of the conductive rubber 27-2. Further, an abrasive-resistant element 27-5 (such as polyester, Teflon, nylon resin and the like) coats the surface layer of the ferroelectric element 27-3. Alternatively, the surface layer of said element 27-3** may be coated with a coating agent prepared by dissolving an organic powder such as polymethyl butyral, polymethyl methacrylate or the like, in a volatile solvent by means of spraying or the like.

Figure 12:
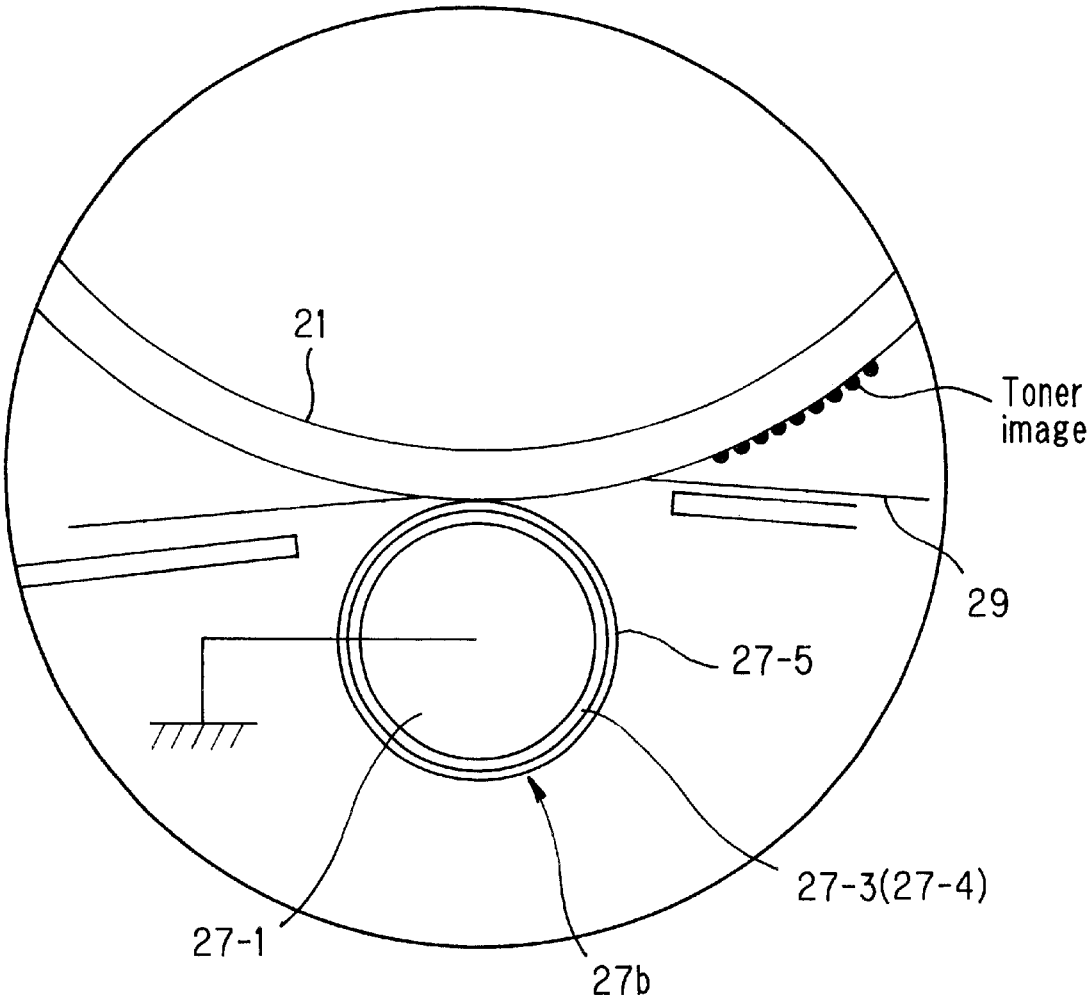
FIG. 12 is a diagram showing the configuration of embodiment 4 of an image forming apparatus of the present invention.

FIG. 12 shows a configuration in which a ferroelectric element (film) 27-3 having a thickness of some μm to some tens of micrometers covered a metal core 27-1 of aluminum, and further the surface of said element 27-3 was covered or coated with the above-mentioned abrasive-resistant element 27-5.

For all the embodiments 2 to 4, it was confirmed that high-quality images could be obtained as in embodiment 1.

<Embodiment 5>

Figure 13:
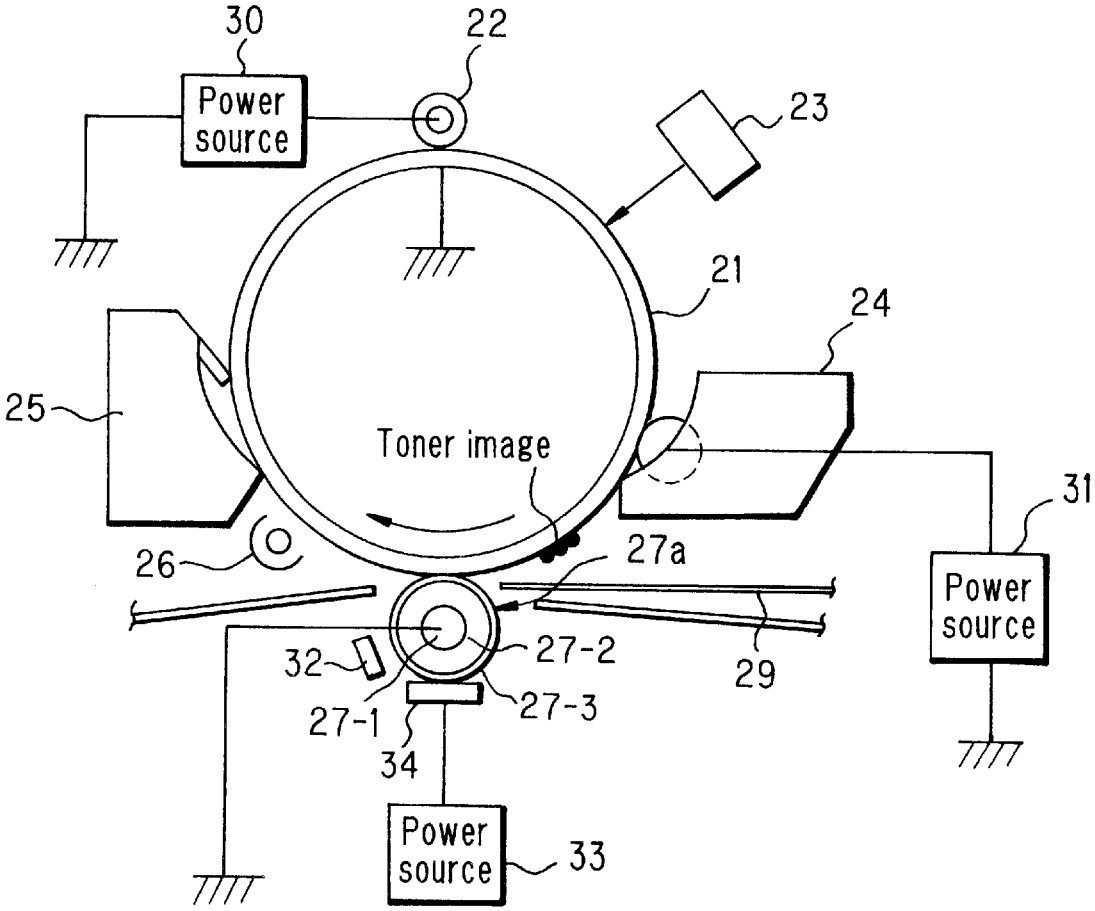
FIG. 13 is a diagram showing the configuration of embodiment 5 of an image forming apparatus of the present invention.

FIG. 13 shows the basic configuration of embodiment 5 of an image forming apparatus according to the present invention.

As shown in FIG. 13, the basic configuration of the image forming portion is almost the same as that shown in FIG. 8 so that the same components are allotted with the same reference numerals. This image forming portion differs from FIG. 8 in the configuration around transfer roller 27*a*. That is, provided around transfer 27*a* are a surface potential detector 32 for detecting the surface potential of ferroelectric element 27-3, a sheet-like heater 34 arranged in abutment with transfer roller 27*a* for heating ferroelectric element 27-3 and a power source 33 for supplying electric energy to sheet-like heater 34.

Surface potential detector 32 monitors time-dependent variation in the surface potential of ferroelectric 27-3. When the value detected by surface potential detector 32 lowers from the initial level, e.g., +1000 V to +900 V, the threshold voltage below which print failure may occur, the ferroelectric layer 27-3 surface is heated to 100° C. by sheet-like heater 34. This releases the unnecessary real charge from the ferroelectric 27-3 surface, so that the initial potential of +1000 V can be restored.

Here, the threshold of the surface potential below which heating of sheet-like heater 34 is needed was determined in the following manner. First, the relationship between the pyroelectric potential of transfer roller 27*a* and the transfer efficiency was determined. The pyroelectric potential when the transfer efficiency was lowered equal to or below 85% was assumed as the print failure occurrence voltage. Allowing a margin for variations of the conditions such environment, paper type, etc., the threshold of the surface potential was set at a potential level at which the transfer efficiency exceeded 90%.

Figure 14:
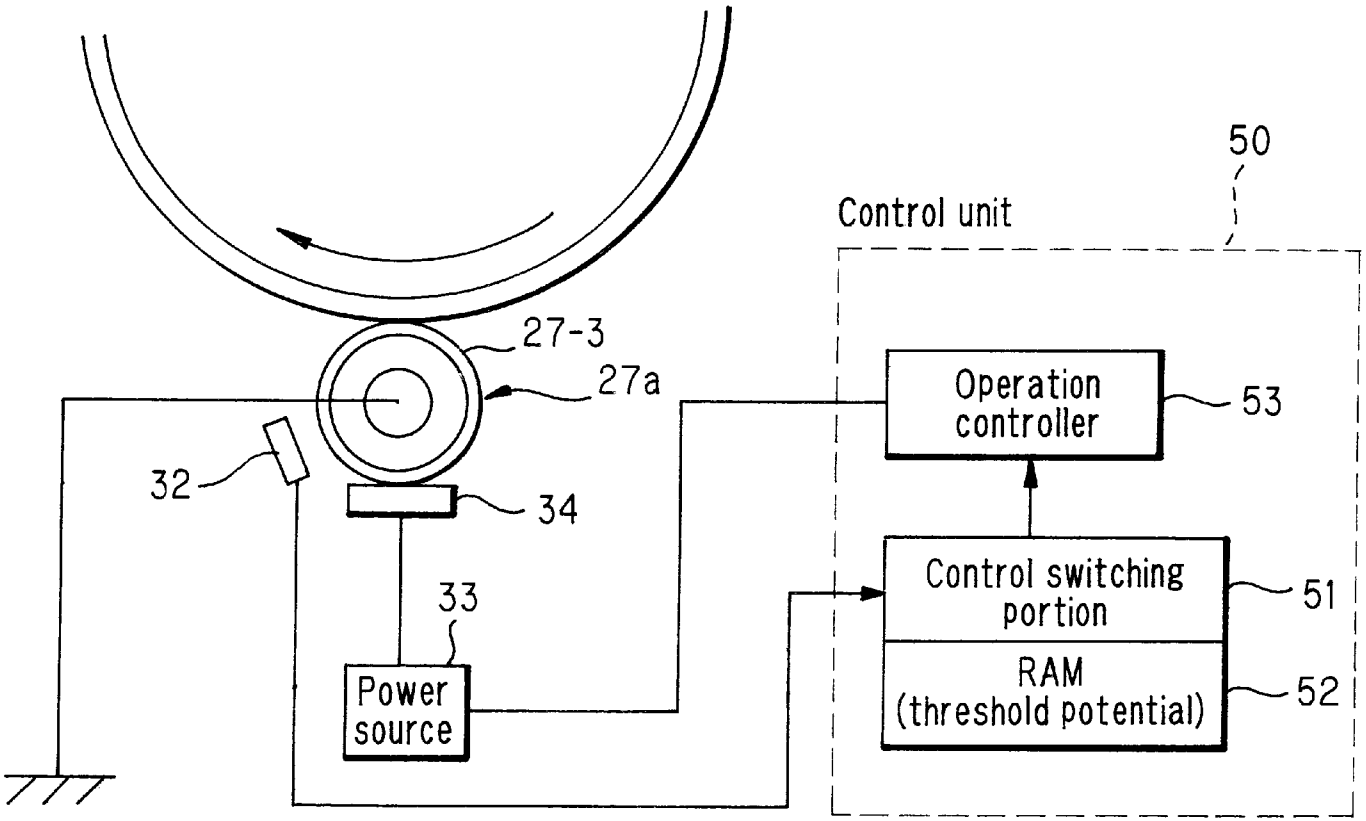
FIG. 14 is a block diagram showing heat control of a ferroelectric.

FIG. 14 is a block diagram showing an electric configuration for heat control of ferroelectric element 27-3 formed on transfer roller 27*a* with sheet-like heater 34.

Transfer roller 27*a* of the image forming apparatus shown in FIG. 13 is controlled by a control unit 50 shown in FIG. 14. This control unit 50 is comprised of a control switching portion 51, RAM 52 and operation controller 53.

The signal detected by surface potential detector 32 is sent to control switching portion 51. The control switching portion 51 reads out the threshold voltage stored beforehand from RAM 52, and transmits a control signal to operation controller 53 so as to activate power source 33 when the detected potential is equal to or lower than this threshold. Power source 33 activated by operation controller 53 causes sheet-like heater 34 to generate heat. Transfer roller 27*a*, as it is rotationally driven, is heated by sheet-like heater 34 so that the surface of ferroelectric element 27-3 is heated to 100° C.

Figure 15:
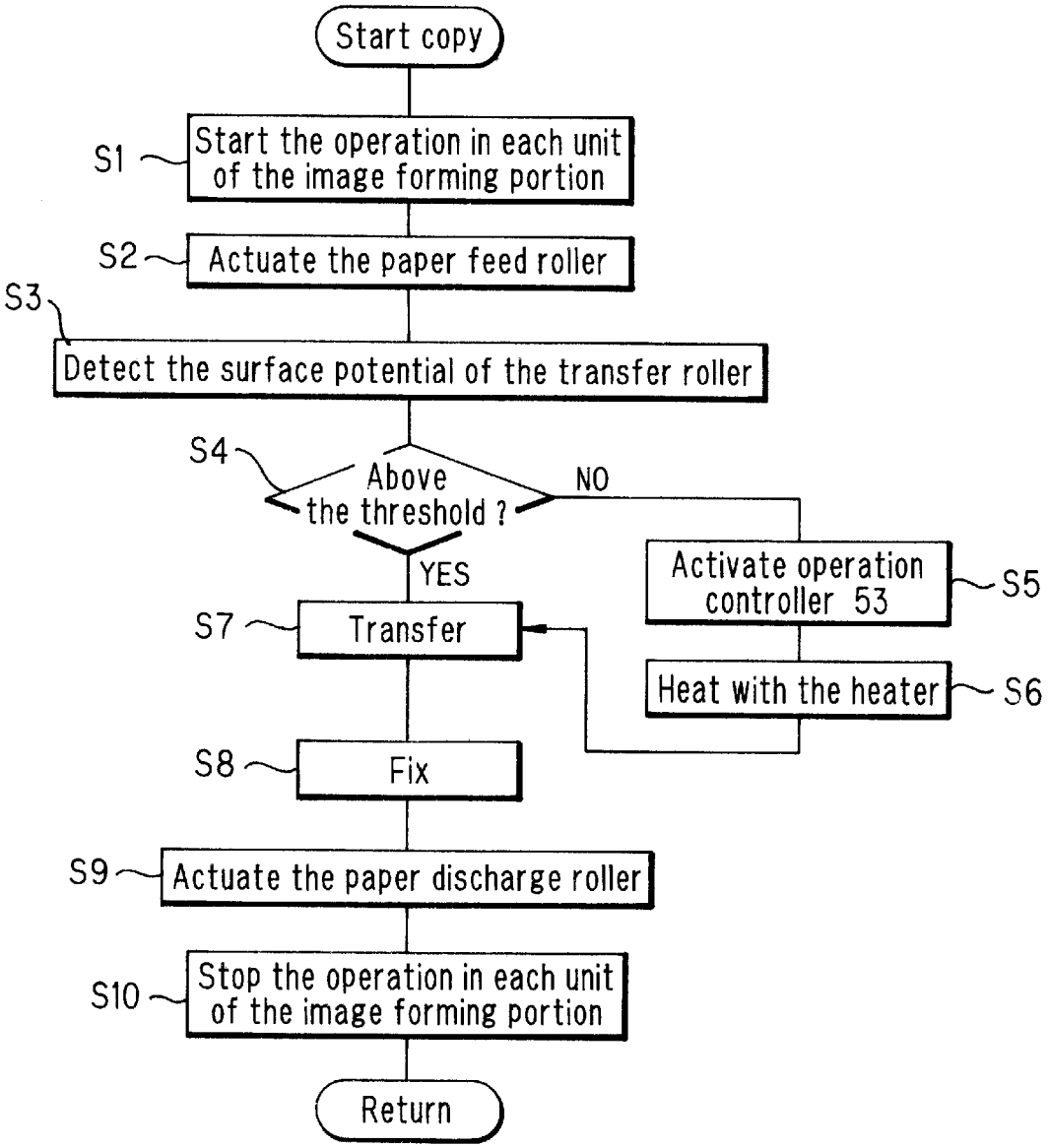
FIG. 15 is a flowchart for illustrating the overall operation of an image forming apparatus of embodiment 5.

FIG. 15 is a flowchart for illustrating the overall operation of an image forming apparatus of embodiment 5.

This image forming apparatus is set ready for an copying operation when the main power is activated. When a copying operation is commanded, the apparatus starts the operation, and actuates the units for various processes involved in image forming at Step S2. At Step S3, the feed roller (not shown) is actuated to start feed of a recording sheet from a paper feed unit (not shown). At Step S4, the surface potential of transfer roller 27*a* is detected by surface potential detector 32. When this value is above the threshold, control switching portion 51 does not cause operation controller 53 to actuate power source 33 and the operation directly goes to Step S7, where the toner image is transferred to transfer medium 29.

At Step S4, when the surface potential of transfer roller 27*a* is detected and the detected value is below the threshold, the operation goes to Step S5, where the operation controller 53 for controlling the operation of power source 33 for sheet-like heater 34 actuates sheet-like heater 34 so that ferroelectric element 27-3 formed on the surface of transfer roller 27*a* is heated to 100° C. as the roller is turned. When the surface potential of transfer roller 27*a* is restored to the initial value, the operation goes to Step S7, where the toner image is transferred to transfer medium 29.

At Step S8, the fixing roller in the fixing unit (not shown) is actuated and transfer medium 29 (FIG. 13) with an unfixed image formed thereon is fed so that the unfixed image is fixed. At Step S9, the paper discharge roller (not shown) is actuated so that the transfer medium with the final image formed thereon is fed to the paper output tray portion. At Step S10, all the units of the image forming portion stop.

An experiment for examining continuous transfer of toner images to a number of transfer media was carried out using the image forming apparatus according to the present invention. The experiment was carried out for the case where the ferroelectric was not heated by heater and for the case where the ferroelectric was heated by the heater. The images obtained from these two cases were compared. As a result, in the former case, transfer failures were observed after continuous printing of about 7400 sheets whereas no transfer failures occurred after printing of 9600 sheets in the latter case.

Figure 16:
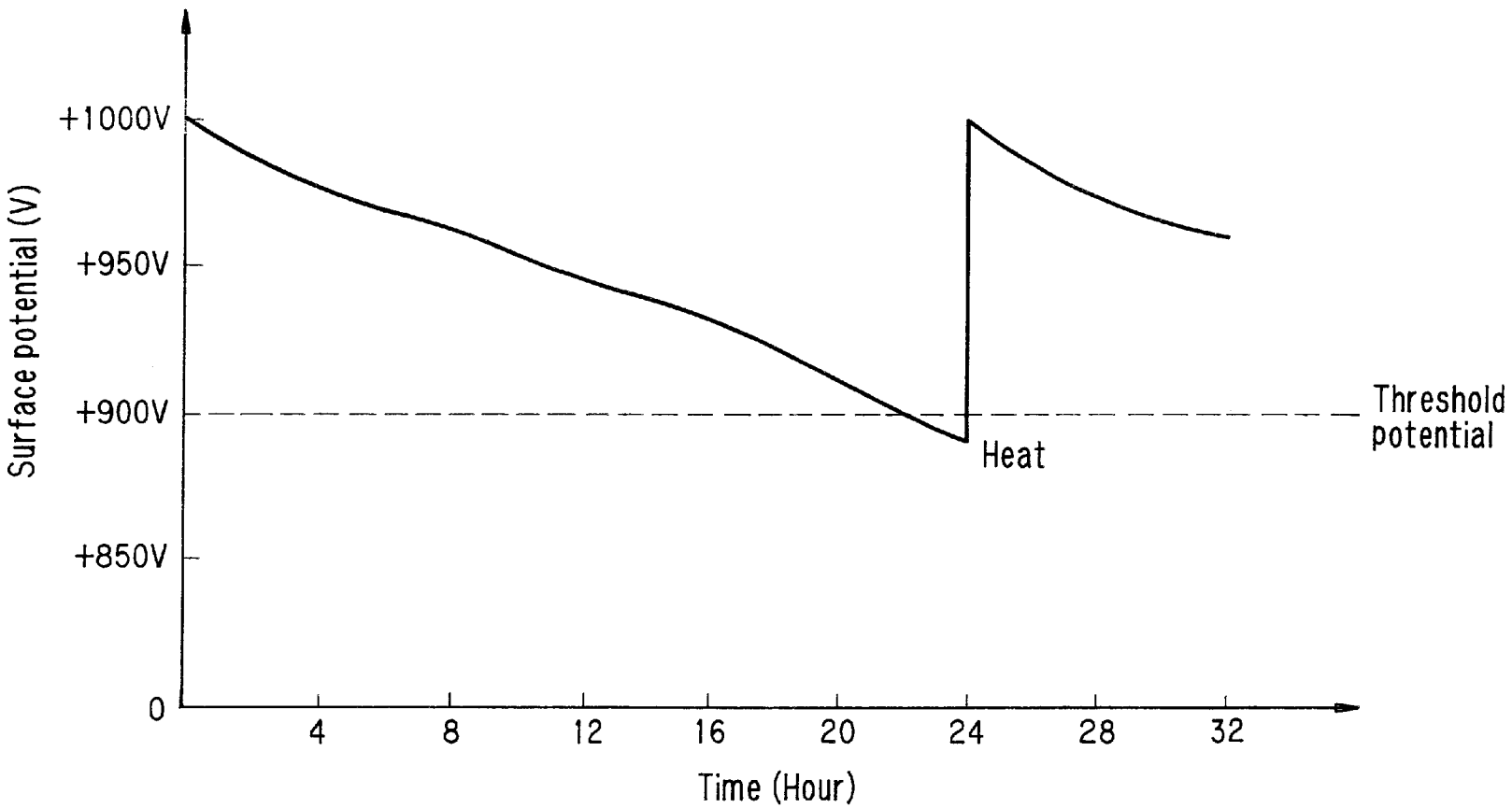
FIG. 16 is a graph showing the time-dependent variation of the surface potential of the ferroelectric layer provided in the transfer device of the image forming apparatus of embodiment 5.

FIG. 16 is a graph showing the time-dependent variation of the surface potential of the ferroelectric layer provided in the transfer device of the image forming apparatus of the present invention.

It was found from this graph that heating of the ferroelectric element once every three days is adequate under usage conditions under which the apparatus is used for 8 hours per day with about 100 sheets printed. This frequency, of course, depends on the usage conditions. It was also found that the restoration to the initial surface potential by heating can be made instantaneously (in practice, by the total time for the runup of the heater to a heating temperature and the time required for the transfer roller to make one revolution).

<Embodiment 6>

Figure 17:
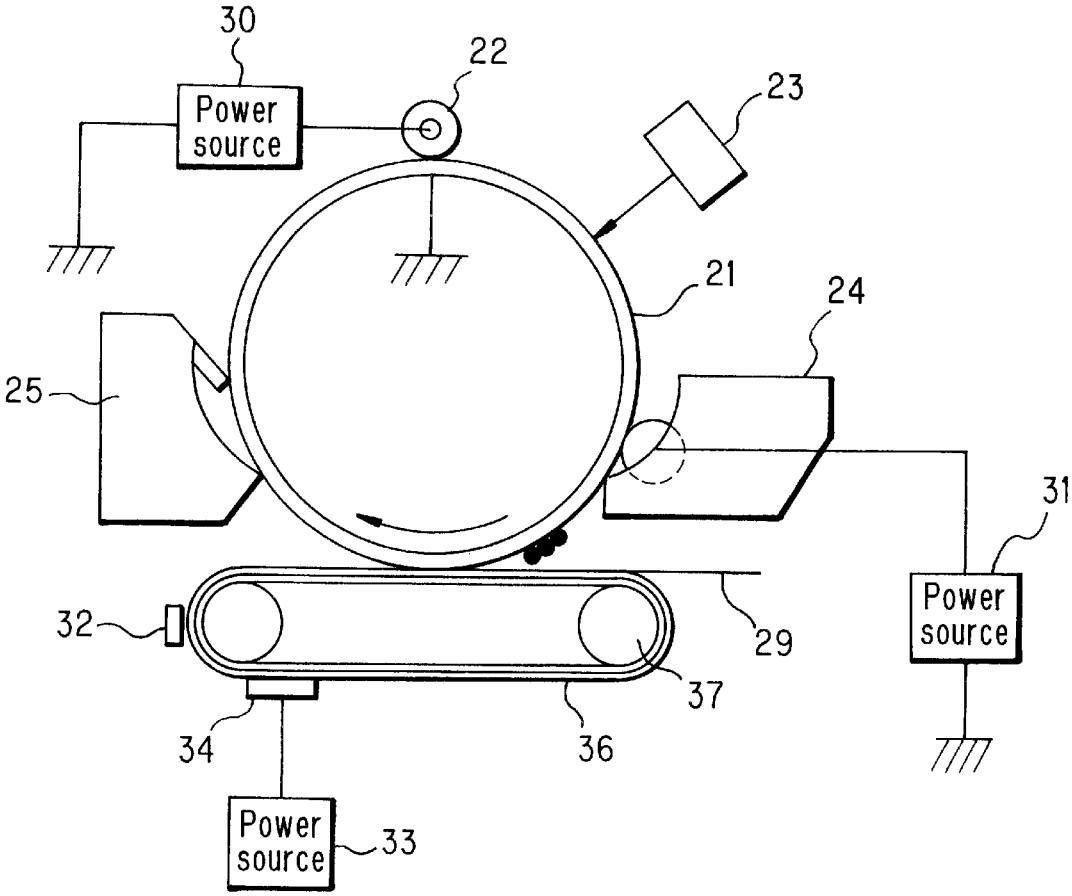
FIG. 17 is a diagram showing the configuration of embodiment 6 of an image forming apparatus of the present invention.

FIG. 17 shows the basic configuration of embodiment 6 of an image forming apparatus according to the present invention. The image forming apparatus shown in FIG. 17 has almost the same configuration as that of FIG. 13 except in that a transfer belt 36 with a ferroelectric layer formed on the surface thereof and a support assembly 37 for supporting the transfer belt 36, a sheet-like heater 34 as the heating means arranged close to or in abutment with part of the transfer belt 36 are provided instead of transfer roller 27*a*.

Time-dependent variation of the surface potential of the ferroelectric is monitored by surface potential detector 32. When the value detected by surface potential detector 32 lowers from the initial level, e.g., +1000 V to +900 V, the threshold voltage below which print failures may occur, the surface of the ferroelectric is heated to 100° C. by sheet-like heater 34. This releases the unnecessary real charge from the surface of the ferroelectric, so that the initial potential of +1000 V is restored. This configuration has the same effects as in the first embodiment.

As another embodiment, a hollow transfer roller may be used as the transfer device so as to incorporate a heater lamp as a heater, surface potential detector and temperature detector therein. When the ferroelectric surface was heated by the heater lamp up to 60° C., almost the same effect as in the first and second embodiments could be obtained. As a still another embodiment, the transfer device is provided with a transfer belt, a hollow roller for supporting the transfer belt incorporating a heater lamp as a heater, surface potential detector and temperature detector therein. When the ferroelectric surface was heated by this heater lamp up to 100° C., almost the same effect as in the fifth and sixth embodiments could be obtained.

The heater for heating the ferroelectric is not particularly limited. For example, the ferroelectric may be heated externally by a non-contact manner or by heat irradiation from a xenon lamp, halogen lamp, etc., by high-power laser, or by bringing a heat roller into contact.

<Embodiment 7>

Figure 18:
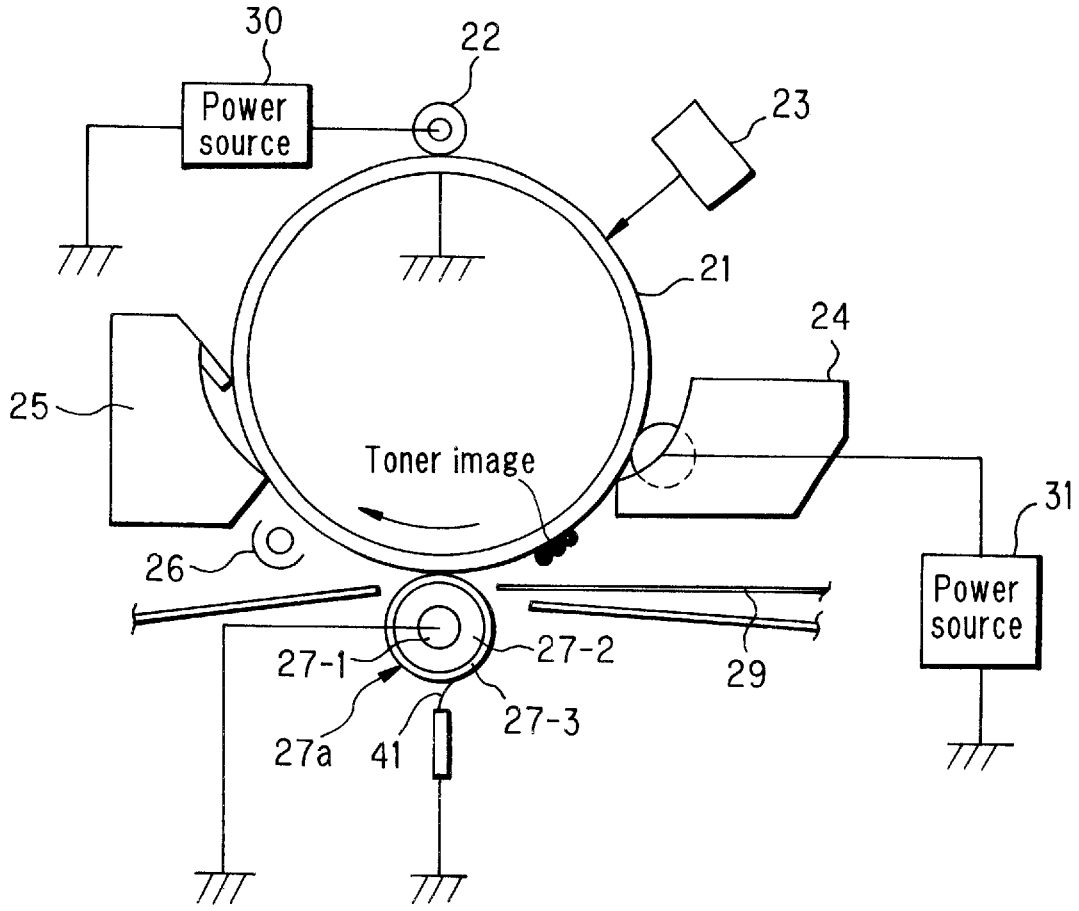
FIG. 18 is a diagram showing the configuration of embodiment 7 of an image forming apparatus of the present invention.

FIG. 18 shows the basic configuration of embodiment 7 of an image forming apparatus according to the present invention.

The image forming apparatus shown in FIG. 18 has almost the same configuration as that shown in FIG. 8. In the image forming apparatus shown in FIG. 18, an erasing brush 41 made up of a multiple number of conductive brushes, functioning as an eraser connected to the earth, is arranged in contact with transfer roller 27*a*.

Since the unnecessary real charge on the ferroelectric surface can be released to the earth side by way of erasing brush 41, the potential of the ferroelectric surface can be continuously maintained at +1000 V, which is the initial pyroelectric potential.

An experiment of examining continuous transfer of toner images to a number of transfer media was carried out using the image forming apparatus according to the present invention. The experiment was carried out for the case where the ferroelectric was not heated by heater and for the case where the ferroelectric was heated by the heater. The images obtained from these two cases were compared. As a result, in the former case, transfer failures were observed after continuous printing of about 7400 sheets whereas no transfer failures occurred after printing of 10000 sheets in the latter case.

Figure 19:
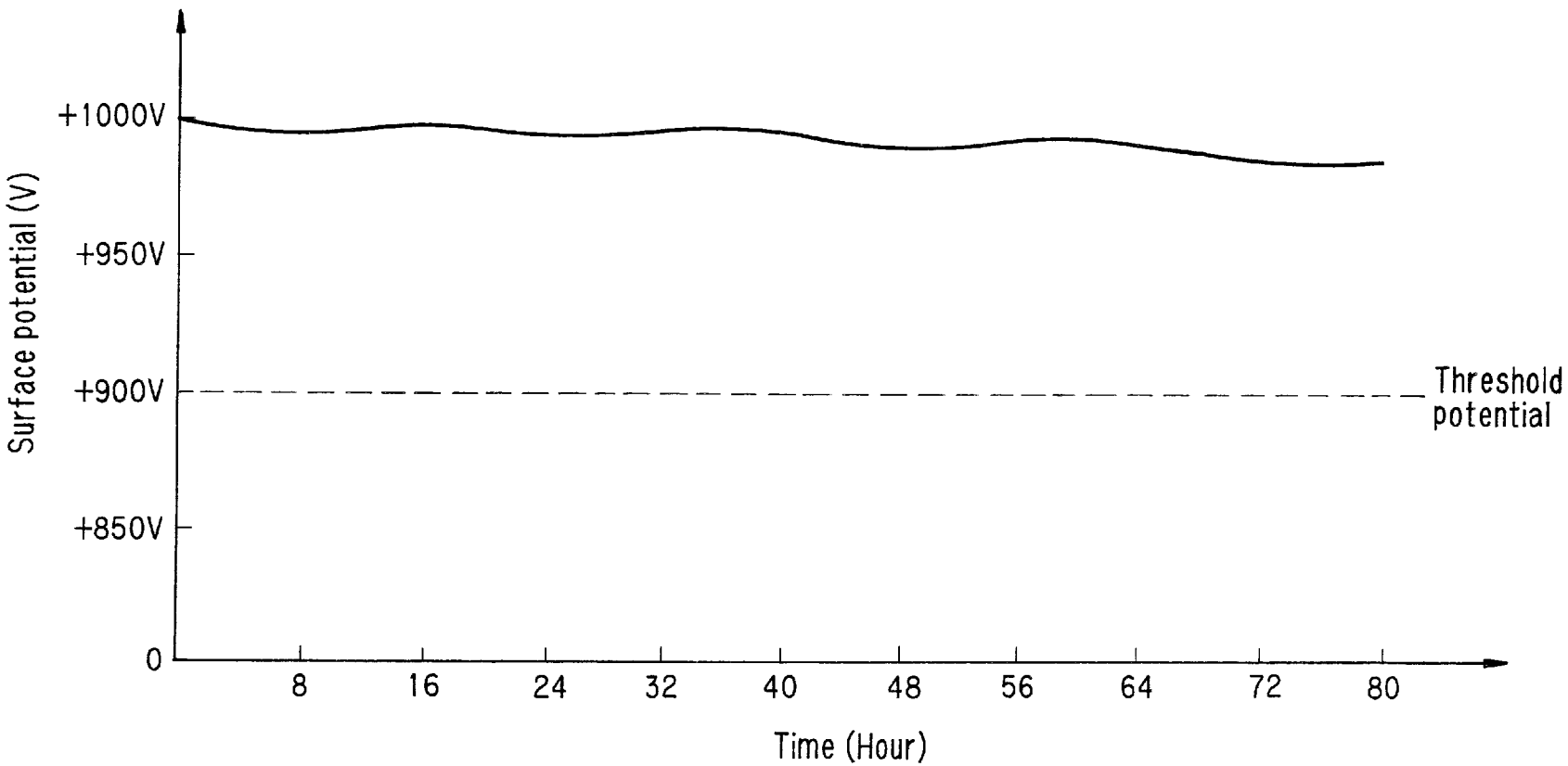
FIG. 19 is a graph showing the time-dependent variation of the surface potential of the ferroelectric layer provided in the transfer device of the image forming apparatus of embodiment 7.

FIG. 19 is a graph showing the time-dependent variation of the surface potential of the ferroelectric layer provided in the transfer device of the image forming apparatus of the present invention. The up-time of the apparatus was eight hours and 1000 sheets were intermittently printed for each day. This was continued for ten days.

It was found from this graph that the attenuation of the surface potential of the ferroelectric element was almost zero under the above usage conditions and can provide high quality images without causing any transfer failures.

<Embodiment 8>

Figure 20:
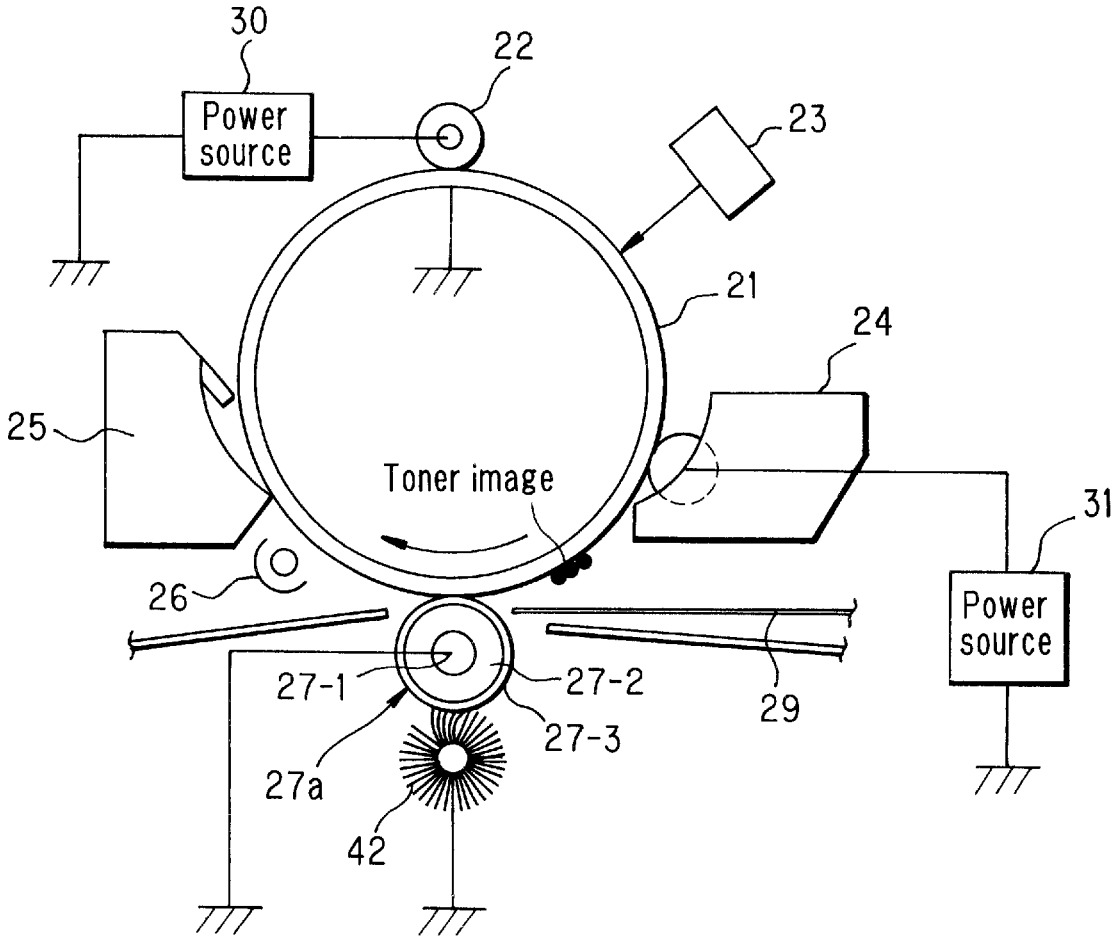
FIG. 20 is a diagram showing the configuration of embodiment 8 of an image forming apparatus of the present invention.

FIG. 20 shows the basic configuration of another embodiment of an image forming apparatus according to the present invention. In FIG. 20, an erasing roller 42 having a conductive surface, functioning as an eraser connected to the earth, is arranged in contact with transfer roller 27*a*. This erasing roller turns following the rotation of transfer roller 27*a*. In this configuration, since the unnecessary real charge on the ferroelectric 27-3 can be released to the earth side, the surface potential of the ferroelectric 27-3 can be continuously maintained at +1000 V, which is the initial pyroelectric potential. Therefore, the same effect can be obtained as that of embodiment 7.

As another embodiment, the transfer device is provided with a transfer belt and a conductive brush connected to the earth or a conductive roller connected to the earth may be put in contact with the transfer belt surface so as to erase the unnecessary charge. With this configuration, almost the same effect as in the seventh and eighth embodiments can be obtained.

As an eraser for erasing the charge of ferroelectric elements is not particularly limited to the above mentioned eraser, but charge can be erased, for example, by abutting a conductive blade thereon.

It should be noted that the present invention is not limited to these embodiments, but the present invention can be generally applied to image forming apparatus such as copiers, laser beam printers, liquid development process, other recording apparatus and the like using electrophotographic process.

According to the first aspect of the present invention, the transfer device is formed with a layer including a ferroelectric at least as part and the ferroelectric is subjected to the dipole orienting treatment (poling treatment). Thus, toner images are transferred to the transfer medium by electric field formed by the dipoles thus oriented. Therefore, there is no need to provide a high-voltage power source for the transfer device. Since no bias voltage needs to be applied from an external high-voltage power supply, it is possible to realize energy-saving, low-cost and downsizing. Further, no Paschen discharge will occur in the micro gap in the vicinity of the nip portion between the image bearer and the transfer device because the relative permittivity of the ferroelectric is high. Therefore, it is possible to provide a perfect ozoneless configuration as well as to prevent occurrence of toner scattering, which contributes to production of high-quality images excellent in dot reproducibility.

According to the second aspect of the present invention, since no transfer bias application means is needed for the transfer device and since no high-voltage application is needed during transfer, it is possible to provide an energy-saving configuration.

According to the third aspect of the present invention, since the transfer device is constructed such that the ferroelectric layer is formed on an electrically conductive support, it is possible to leak the unnecessary real charge residing on the ferroelectric layer surface to the electrically conductive support during poling treatment, whereby an arbitrary surface potential owing to permanent dipoles can be made to appear.

According to the fourth aspect of the present invention, since the electrically conductive support on which the ferroelectric is grounded, it is possible to leak the unnecessary real charge residing on the ferroelectric layer surface during poling treatment, whereby it is possible to produce a pyroelectric potential resulting from permanent dipoles on the ferroelectric surface.

According to the fifth aspect of the present invention, since the polarity of the ferroelectric layer is set positive when the toner on the image bearer is charged negative and the polarity of the ferroelectric layer is set negative when the toner on the image bearer is charged positive, it is possible to transfer the toner image to the transfer medium in a beneficial manner taking advantage of the potential difference between the two.

According to the sixth aspect of the present invention, since a potential difference is given between the surface potential of the ferroelectric and that of the toner portion on the image bearer, it is possible to transfer the toner image to the transfer medium in a beneficial manner.

According to the seventh aspect of the present invention, the ferroelectric layer is formed with a film thickness of 8 $\mu$m or greater. Since 1 $\mu$m of a ferroelectric is able to provide a pyroelectric portion of 25 V, a pyroelectric potential of +(−)200 V can be semi-permanently provided for the transfer device with a ferroelectric layer of 8 $\mu$m thick, thus making it possible to transfer toner images to transfer media without the necessity of using a high-voltage power supply for the transfer device.

According to the eighth aspect of the present invention, since the ferroelectric at least includes an organic material as part thereof, it is possible to orient the permanent dipoles under application of a relatively low biasing coercive field, hence it is possible to make stable the poling characteristics of the ferroelectric as well as to provide a high pyroelectric potential stable with respect to the passage of time.

According to the ninth aspect of the present invention, since the ferroelectric at least includes an inorganic material as part thereof, it is possible to orient the permanent dipoles under application of a relatively low biasing coercive field, hence it is possible to make stable the poling characteristics of the ferroelectric as well as to provide a high pyroelectric potential stable with respect to the passage of time.

According to the tenth aspect of the present invention, since the inorganic material is a ceramics sintered compact composed of at least three components, it is possible to provide a transfer roller which is nonpolluting and has high durability.

According to the eleventh aspect of the present invention, since the surface layer of the ferroelectric is covered or coated with an abrasive-resistant material, it is possible to provide a transfer roller that has a high durability, with no risk of the ferroelectric wearing and without the necessity of a high-voltage power source.

According to the twelfth aspect of the present invention, by setting the relative permittivitty of the ferroelectric equal to or greater than 10, it is possible to obtain a large polarization charge with a relatively weak electric field and hence provide a high transfer efficiency.

According to the thirteenth aspect of the present invention, since the volume resistivity of the ferroelectric is set so as to fall within the range from $10^{14}$ Ω•cm to $10^{15}$ Ω•cm, it is possible to make stable the poling characteristics of the ferroelectric as well as to provide a high pyroelectric potential which is stable with passage of time.

According to the fourteenth aspect of the present invention, since a ferroelectric of which the volume resistivity becomes equal to or lower than $10^{12}$ Ω•cm when it is heated to a temperature below the Curie temperature is selected, it is possible to disorder the orientation of the dipoles so as to break the equilibrium with the real charge on the ferroelectric surface. Therefore, the unnecessary real charge residing on the ferroelectric surface during poling can be released so that the ferroelectric surface can provide the pyroelectric potential owing to permanent dipoles.

According to the fifteenth aspect of the present invention, by providing a heater for heating the ferroelectric layer formed in the transfer device, apparent attenuation of the surface potential on the ferroelectric can be prevented effectively, thus making it possible to perform a beneficial transfer operation.

According to the sixteenth aspect of the present invention, by providing a potential detector for detecting the surface potential of the ferroelectric layer formed in the transfer device so as to monitor the ferroelectric surface potential, it is possible to prevent transfer failures from occurring due to attenuation of the pyroelectric potential of the ferroelectric.

According to the seventeenth aspect of the present invention, by providing a potential detector for detecting the surface potential of the ferroelectric layer formed in the transfer device to control the operation of a heater based on the detected signal from the potential detector, it is possible to prevent transfer failures due to reduction of the pyroelectric potential of the ferroelectric as well as to save energy by efficient heating.

Further, since the ferroelectric layer formed in the transfer device is heated within the range below the Curie temperature, it is possible to leak the unnecessary charge out of the ferroelectric surface without disturbing the polarization charge formed in the ferroelectric layer so that the ferroelectric surface can provide the pyroelectric potential owing to permanent dipoles.

According to the eighteenth aspect of the present invention, by providing an erasing device for neutralizing the unnecessary real charge on the ferroelectric layer formed in the transfer device, it is possible to efficiently prevent the ferroelectric surface potential from lowering, hence perform a beneficial transfer operation.

According to the nineteenth aspect of the present invention, since a conductive brush is used as the erasing portion, it is possible to efficiently prevent the ferroelectric surface potential from lowering, hence perform a beneficial transfer operation.

According to the twentieth aspect of the present invention, since a conductive roller is used as the erasing portion, it is possible to efficiently prevent the ferroelectric surface potential from lowering, hence perform a beneficial transfer operation.

According to the twenty-first aspect of the present invention, since the erasing portion is grounded, it is possible to effectively erase the unnecessary real charge from the ferroelectric surface. That is, it is possible to efficiently prevent the ferroelectric surface potential from lowering and perform a beneficial transfer operation.

According to the twenty-second aspect of the present invention, the transfer device is provided in a roller configuration which is comprised of a metal core, an electrically conductive elastomer as the first deposited layer formed on the metal core surface and a conductive film or conductive tube formed with a ferroelectric layer as the second deposited layer formed on the first deposited layer. Therefore, it is possible to mass produce the transfer roller of a ferroelectric laminated type by a simple, low-cost manufacturing process. Further, use of the elastomer as the support substrate makes it possible to form a large transfer nip, which leads to a beneficial transfer operation.

According to the twenty-third aspect of the present invention, the transfer device is provided in a roller configuration which is comprised of a metal core and a conductive film or conductive tube formed with a ferroelectric layer as the first deposited layer formed on the metal core surface. Therefore, it is possible to mass produce the transfer roller of a ferroelectric laminated type by a simple, low-cost manufacturing process.

Further, since the transfer device is provided in a roller configuration in which the ferroelectric layer is coated on the surface of a metal core, it is possible to mass produce the transfer roller of a ferroelectric laminated type by a simple, low-cost manufacturing process.

According to the twenty-fourth aspect of the present invention, since the surface of the metal core made of aluminum in contact with the ferroelectric layer is anodized, it is possible to provide tough bonding between the ferroelectric layer and the core metal.

According to the twenty-fifth aspect of the present invention, since the transfer device is provided in a roller configuration in which the surface layer of the ferroelectric layer is covered or coated with an abrasive-resistant material, it is possible to prevent the ferroelectric layer from wearing due to contact with the photosensitive member or transfer media.

What is claimed is:

1. An image forming apparatus including a transfer device for transferring toner images from an image bearer to a transfer medium, comprising:

a ferroelectric subjected to a dipole orienting treatment and a heat treatment to a particular temperature after the dipole orienting treatment, and the transfer device being arranged opposing to the image bearer and having a layer containing the ferroelectric at least as part, wherein the toner images are transferred to the transfer medium by electric field formed by the dipoles thus oriented.

2. The image forming apparatus according to claim 1, wherein the transfer device is set floating without any voltage applied thereto.

3. An image forming apparatus including a transfer device for transferring toner images from an image bearer to a transfer medium, comprising:

a ferroelectric subjected to a dipole orienting treatment, and the transfer device being arranged opposing to the image bearer and having a layer containing the ferroelectric at least as part, wherein the transfer device is constructed such that the ferroelectric layer is formed on a grounded electrically conductive support, and wherein the toner images are transferred to the transfer medium by an electric field formed by the dipoles thus oriented.

4. The image forming apparatus according to claim 1 or claim 2 or claim 3, wherein polarity of the ferromagnetic layer is set positive when the toner on the image bearer is charged negative and polarity of the ferroelectric layer is set negative when the toner on the image bearer is charged positive.

5. The image forming apparatus according to claim 1 or claim 2 or claim 3, wherein a potential difference is given between the surface potential of the ferroelectric and that of the toner portion on the image bearer.

6. The image forming apparatus according to claim 1 or claim 2 or claim 3, wherein the ferroelectric layer is formed with a film thickness of 8 $\mu$m or greater.

7. The image forming apparatus according to claim 1 or claim 2 or claim 3, wherein the ferroelectric at least includes an organic material as part thereof.

8. The image forming apparatus according to claim 1 or claim 2 or claim 3, wherein the ferroelectric at least includes an inorganic material as part thereof.

9. The image forming apparatus according to claim 8, wherein the inorganic material is a ceramics sintered compact composed of at least three components.

10. The image forming apparatus according to claim 1 or claim 2 or claim 3, wherein an abrasive-resistant material covers or coats the surface layer of the ferroelectric.

11. The image forming apparatus according to claim 1 or claim 2 or claim 3, wherein the relative permittivity of the ferroelectric is set equal to or greater than 10.

12. The image forming apparatus according to claim 1 or claim 2 or claim 3, wherein the volume resistivity of the ferroelectric falls within the range from $10^{14'}$ Ω•cm to $10^{15'}$ Ω•cm.

13. The image forming apparatus according to claim 12, wherein the volume resistivity of the ferroelectric is set to be equal to or lower than $10^{12}$ Ω•cm when it is heated within the range below the Curie temperature.

14. The image forming apparatus according to claim 1 or claim 2 or claim 3, further comprising a heater for heating the ferroelectric layer arranged close to or in abutment with the ferromagnetic layer.

15. The image forming apparatus according to claim 1 or claim 2 or claim 3, further comprising a potential detector for detecting the surface potential of the transfer device.

16. The image forming apparatus according to claim 1 or claim 2 or claim 3, further comprising: a heater for heating the ferroelectric layer arranged close to or in abutment with the ferroelectric layer; and a potential detector for detecting the surface potential of the transfer device.

17. The image forming apparatus according to claim 16, wherein based on the detected signal from the potential detector, the ferroelectric is heated under control up to the Curie temperature by the heater.

18. The image forming apparatus according to claim 1 or claim 2 or claim 3, further comprising an erasing portion for erasing the charge on the ferroelectric layer.

19. The image forming apparatus according to claim 18, wherein the erasing portion is a conductive brush arranged in abutment with the transfer device.

20. The image forming apparatus according to claim 18, wherein the erasing portion is a conductive roller having a conductive surface arranged in abutment with the transfer device.

21. The image forming apparatus according to claim 18, wherein the erasing portion is grounded.

22. The image forming apparatus according to claim 1 or claim 2 or claim 3, wherein the transfer device is provided in a roller configuration which is comprised of a metal core, an electrically conductive elastomer as a first coating layer formed on the metal core surface and the ferroelectric as a second coating layer formed on the first coating layer.

23. The image forming apparatus according to claim 22, wherein the transfer device is configured so that an abrasive-resistant material covers or coats the surface layer of the ferroelectric.

24. The image forming apparatus according to claim 22, wherein the surface potential in the ferroelectric layer of the transfer device is uniformly electrified at a potential within the range from +200 V to +1600 V, by the dipole orienting treatment.

25. The image forming apparatus according to claim 1 or claim 2 or claim 3, wherein the transfer device is provided in a roller configuration which is comprised of a metal core and the ferroelectric layer as a first coating layer formed on the metal core surface.

26. The image forming apparatus according to claim 25, wherein the metal core is an aluminum core and the surface thereof in contact with the ferroelectric layer is anodized.

27. The image forming apparatus according to claim 25, wherein the transfer device is configured so that an abrasive-resistant material covers or coats the surface layer of the ferroelectric.

28. The image forming apparatus according to claim 25, wherein the surface potential in the ferroelectric layer of the transfer device is uniformly electrified at a potential within the range from +200 V to +1600 V, by the dipole orienting treatment.

* * * * *